US011718977B2

(12) United States Patent
Kumagai et al.

(10) Patent No.: US 11,718,977 B2
(45) Date of Patent: Aug. 8, 2023

(54) WORK MACHINE

(71) Applicant: Hitachi Construction Machinery Co., Ltd., Tokyo (JP)

(72) Inventors: Kento Kumagai, Ami-machi (JP); Shinya Imura, Toride (JP); Yasutaka Tsuruga, Ryugasaki (JP); Takaaki Chiba, Kasumigaura (JP); Hiroaki Amano, Tsukuba (JP); Shinji Nishikawa, Kasumigaura (JP); Akihiro Narazaki, Tsukuba (JP); Genroku Sugiyama, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/640,947

(22) PCT Filed: Nov. 2, 2020

(86) PCT No.: PCT/JP2020/041098
§ 371 (c)(1),
(2) Date: Mar. 7, 2022

(87) PCT Pub. No.: WO2021/192389
PCT Pub. Date: Sep. 30, 2021

(65) Prior Publication Data

US 2022/0333352 A1 Oct. 20, 2022

(30) Foreign Application Priority Data

Mar. 27, 2020 (JP) ..... JP2020-058818

(51) Int. Cl.
*E02F 9/22* (2006.01)
*E02F 9/20* (2006.01)

(52) U.S. Cl.
CPC ..... *E02F 9/2292* (2013.01); *E02F 9/2004* (2013.01); *E02F 9/2228* (2013.01); *E02F 9/2296* (2013.01)

(58) Field of Classification Search
CPC . F15B 2211/46; F15B 2211/45; E02F 9/2292; E02F 9/2228
See application file for complete search history.

(56) References Cited

U.S. PATENT DOCUMENTS 5,835,874 A 11/1998 Hirata et al.
9,725,884 B2 * 8/2017 Hashimoto ..... E02F 9/2242
(Continued)

FOREIGN PATENT DOCUMENTS

JP 3056254 B2 6/2000
JP 5026228 B2 9/2012
(Continued)

OTHER PUBLICATIONS

International Preliminary Report on Patentability (PCT/IB/338 & PCT/IB/373) issued in PCT Application No. PCT/JP2020/041098 dated Oct. 6, 2022, including English translation of document C2 (Japanese-language Written Opinion (PCT/ISA/237) filed on Mar. 7, 2022) (six (6) pages).
(Continued)

*Primary Examiner* — Abiy Teka
(74) *Attorney, Agent, or Firm* — Crowell & Moring LLP

(57) ABSTRACT

Provided is a work machine which can achieve both of excellent operability when an operator manually operates a machine body or a work device and an accuracy of control of the machine body or the work device when a controller performs automatic control. The controller is configured to, in a case where the automatic control function selector switch gives an instruction to disable the automatic control function, adjust an opening amount of a bleed-off valve to a
(Continued)

maximum opening amount or an opening amount corresponding to input amounts of control levers, and in a case where the automatic control function selector switch gives the instruction to enable the automatic control function, adjust the opening amount of the bleed-off valve, in at least part of an operation region of the control levers, so as to be smaller than the opening amount with the instruction to disable the automatic control function being given.

4 Claims, 11 Drawing Sheets

(56) References Cited

U.S. PATENT DOCUMENTS

| | | | | |
|---|---|---|---|---|
| 10,676,898 | B2 * | 6/2020 | Takahashi | F15B 11/02 |
| 10,895,059 | B2 * | 1/2021 | Misaki | E02F 3/32 |
| 11,453,995 | B2 * | 9/2022 | Ito | E02F 3/437 |
| 2014/0090369 | A1 | 4/2014 | Nakamura et al. | |
| 2015/0252819 | A1 | 9/2015 | Imura et al. | |
| 2020/0308808 | A1 | 10/2020 | Nakajima | |
| 2021/0002868 | A1 | 1/2021 | Kumagai et al. | |

FOREIGN PATENT DOCUMENTS

| | | | |
|---|---|---|---|
| JP | 5572586 | B2 | 8/2014 |
| JP | 5886976 | B2 | 3/2016 |
| JP | 2019-94973 | A | 6/2019 |
| JP | 2020-7879 | A | 1/2020 |

OTHER PUBLICATIONS

International Search Report (PCT/ISA/210) issued in PCT Application No. PCT/JP2020/041098 dated Jan. 26, 2021 with English translation (five (5) pages).

Japanese-language Written Opinion (PCT/ISA/237) issued in PCT Application No. PCT/JP2020/041098 dated Jan. 26, 2021 (four (4) pages).

* cited by examiner

WORK MACHINE

TECHNICAL FIELD

The present invention relates to a work machine such as a hydraulic excavator.

BACKGROUND ART

A work machine such as a hydraulic excavator includes a machine body including a swing structure, and a work device (front implement) attached to the swing structure. The work device includes a boom (front implement member) rotatably connected to the swing structure, an arm (front implement member) rotatably connected to a distal end of the boom, an arm (front implement member) rotatably connected to a distal end of the boom, a bucket (front implement member) rotatably connected to a distal end of the arm, a boom cylinder (actuator) that drives the boom, an arm cylinder (actuator) that drives the arm, and a bucket cylinder (actuator) that drives the bucket. When the front implement members of the work implement are operated by respective manual control levers in such a work machine, the machine body of the work machine is desired to provide excellent operability. Therefore, a hydraulic system including open center directional control valves as disclosed in Patent Document 1 adopts a bleed-off function in order to smooth operation by reducing vibration and shock at a time of a start of operation of an actuator. This bleed-off function discharges, to a tank via a bleed-off circuit, part of operating fluid supplied from a fluid pump to the actuator.

On the other hand, it is not easy to excavate a predetermined region by operating the front implement members of the work machine by the respective manual control levers. An operator needs to have skilled operating techniques. Accordingly, a technology for facilitating such work has been proposed (Patent Document 2).

An area limiting excavation control system of a construction machine described in Patent Document 2 includes detecting means for detecting the position of a front implement, a controller including a computing section configured to compute the position of the front implement on the basis of a signal from the detecting means, a setting section configured to set an entry prohibiting region that the front implement is prohibited from entering, and a computing section configured to calculate a control gain of a control lever signal from the entry prohibiting region and the front implement position, and actuator control means for controlling the movement of an actuator from the calculated control gain. According to such a configuration, a lever operation signal is controlled according to a distance to a boundary line of the entry prohibiting region. Thus, even when an operator erroneously tries to move a distal end of a bucket to the entry prohibiting region, the trajectory of the distal end of the bucket is automatically controlled so as to be along the boundary. Consequently, anyone can perform stable work with high accuracy without depending on a degree of mastery of the operating techniques by the operator.

PRIOR ART DOCUMENT

Patent Documents

Patent Document 1: JP-5572586-B
Patent Document 2: JP-3056254-B

SUMMARY OF THE INVENTION

Problems to be Solved by the Invention

However, there are the following problems when the bleed-off function of Patent Document 1 is implemented in the construction machine described in Patent Document 2 in order to achieve both of excellent operability when the machine body or the work device is operated manually and an accuracy of control of the machine body or the work device when the controller performs automatic control.

When the automatic control of the machine body is performed according to a command from the controller, it is important for a distal end of the front implement to move accurately along a target trajectory. For this purpose, the actuator needs to be supplied with a target flow rate accurately. However, part of a flow rate delivered from the pump is discharged to the tank by the bleed-off function. Thus, there may occur a shortage of the flow rate supplied for the target flow rate of the actuator and a delay time until the target flow rate is reached, so that a decrease in accuracy of control of the position and speed of the actuator may be incurred. In addition, a bleed-off flow rate depends on pressure. Thus, when a load on the actuator varies, the bleed-off flow rate also changes, so that flow rate supply to the actuator may become unstable.

The present invention has been made in view of the above-described problems. It is an object of the present invention to provide a work machine that can achieve both of excellent operability when an operator manually operates a machine body or a work device and an accuracy of control of the machine body or the work device when a controller performs automatic control.

Means for Solving the Problems

In order to achieve the above object, according to the present invention, there is provided a work machine including: a work machine including: a machine body; a work device attached to the machine body; a plurality of actuators that drive the machine body or the work device; a hydraulic fluid tank; a hydraulic pump that sucks hydraulic fluid from the hydraulic fluid tank and that supplies the hydraulic fluid to the plurality of actuators; a plurality of flow rate controllers that are connected in parallel to a delivery line of the hydraulic pump and that control flow rates of the hydraulic fluid supplied from the hydraulic pump to the plurality of actuators; control levers for giving instructions for operation of the plurality of actuators; a pilot pump; a plurality of solenoid proportional valves that reduce pressure of hydraulic fluid supplied from the pilot pump and that generate operation pressures of the plurality of flow rate controllers; a controller that outputs command signals to the plurality of solenoid proportional valves according to operation amounts of the control levers; and an automatic control function selector switch for giving an instruction to enable or disable an automatic control function for the machine body or the work device, the controller being configured to, in a case where the automatic control function selector switch gives an instruction to enable the automatic control function, perform the automatic control function by correcting the command signals to the plurality of solenoid proportional valves, wherein the work machine includes a bleed-off valve that is disposed on a hydraulic fluid line connecting the delivery line to the hydraulic fluid tank and adjusts a flow rate of the hydraulic fluid returned from the delivery line to the hydraulic fluid tank, and the controller is configured to, in a case where the automatic control function selector switch gives an instruction to disable the automatic control function, adjust an opening amount of the bleed-off valve to a maximum opening amount or an opening amount corresponding to input amounts of the control levers, and in a case where the automatic control function selector switch gives the instruction to enable the automatic control function, adjust the opening amount of the bleed-off valve, in at least part of an operation region of the control levers, so as to be smaller than the opening amount with the instruction to disable the automatic control function being given.

According to the present invention configured as described above, when the region limiting control function is disabled (when the operator manually operates the machine body or the work device), the bleed-off function smooths operation by reducing vibration and shock at a time of a start of operation of an actuator, and thereby, excellent operability can be ensured. On the other hand, when the region limiting control function is enabled (when the controller performs automatic control), a shortage of the flow rate supplied from the hydraulic pump for the target flow rate of the actuator and a delay until the target flow rate is reached are eliminated by suppressing the bleed-off function, and thus, an accuracy of control of the actuator can be ensured. It is thereby possible to achieve both of excellent operability when the operator manually operates the machine body or the work device and an accuracy of control of the machine body or the work device when the controller performs automatic control.

Advantages of the Invention

The work machine according to the present invention can achieve both of excellent operability when an operator manually operates the machine body or the work device and an accuracy of control of the machine body or the work device when the controller performs automatic control.

MODES FOR CARRYING OUT THE INVENTION

Figure 1:
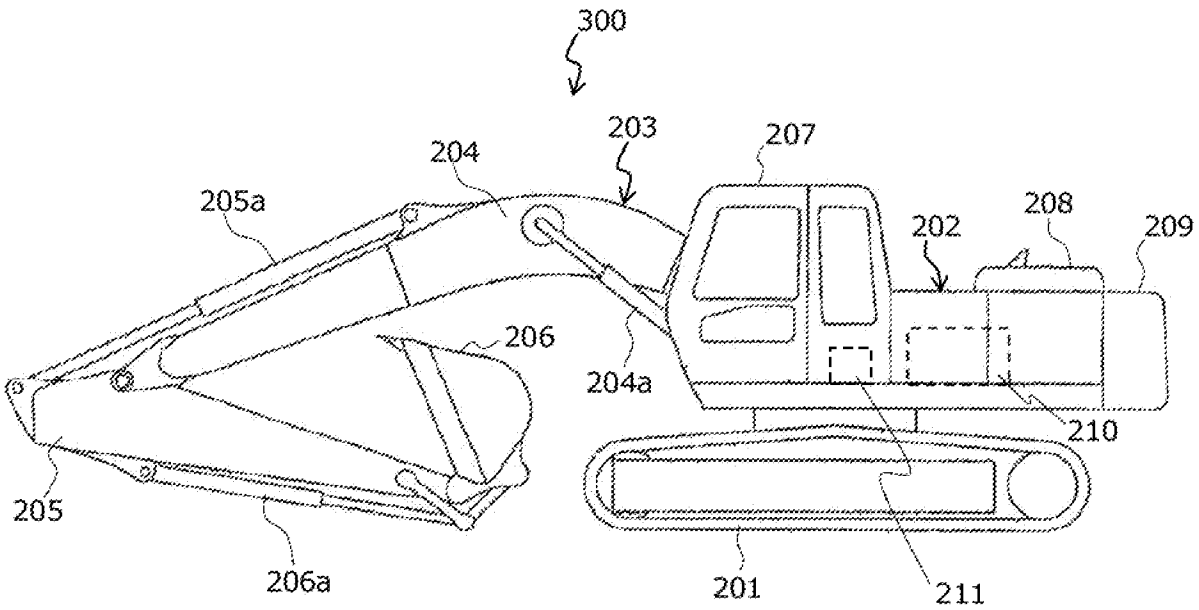
FIG. 1 is a side view of a hydraulic excavator according to an embodiment of the present invention.

Description will hereinafter be made with reference to the drawings by taking a hydraulic excavator as a work machine according to an embodiment of the present invention as an example. Incidentally, in the figures, similar members are identified by the same reference numerals, and repeated description thereof will be omitted as appropriate.

FIG. 1 is a side view of a hydraulic excavator according to the present embodiment.

As depicted in FIG. 1, a hydraulic excavator 300 includes a track structure 201, a swing structure 202 that is swingably disposed on the track structure 201 and that constitutes a machine body, and a work device 203 that is attached to the swing structure 202 so as to be rotatable in an upward-downward direction and that performs excavation work on soil, or the like. The swing structure 202 is driven by a swing motor 211.

The work device 203 includes a boom 204 attached to the swing structure 202 so as to be rotatable in the upward-downward direction, an arm 205 attached to a distal end of the boom 204 so as to be rotatable in the upward-downward direction, and a bucket 206 attached to a distal end of the arm 205 so as to be rotatable in the upward-downward direction. The boom 204 is driven by a boom cylinder 204*a*. The arm 205 is driven by an arm cylinder 205*a*. The bucket 206 is driven by a bucket cylinder 206*a*.

A cab 207 is provided at a front side position on the swing structure 202. A counterweight 209 that ensures a weight balance is provided at a rear side position on the swing structure 202. A machine room 208 is provided between the cab 207 and the counterweight 209. The machine room 208 houses an engine, hydraulic pumps, a control valve 210, and the like. The control valve 210 controls a flow of hydraulic fluid supplied from the hydraulic pumps to each actuator.

The hydraulic excavator 300 according to the present embodiment includes a hydraulic drive system to be described in each following embodiment.

First Embodiment

Figure 2A:
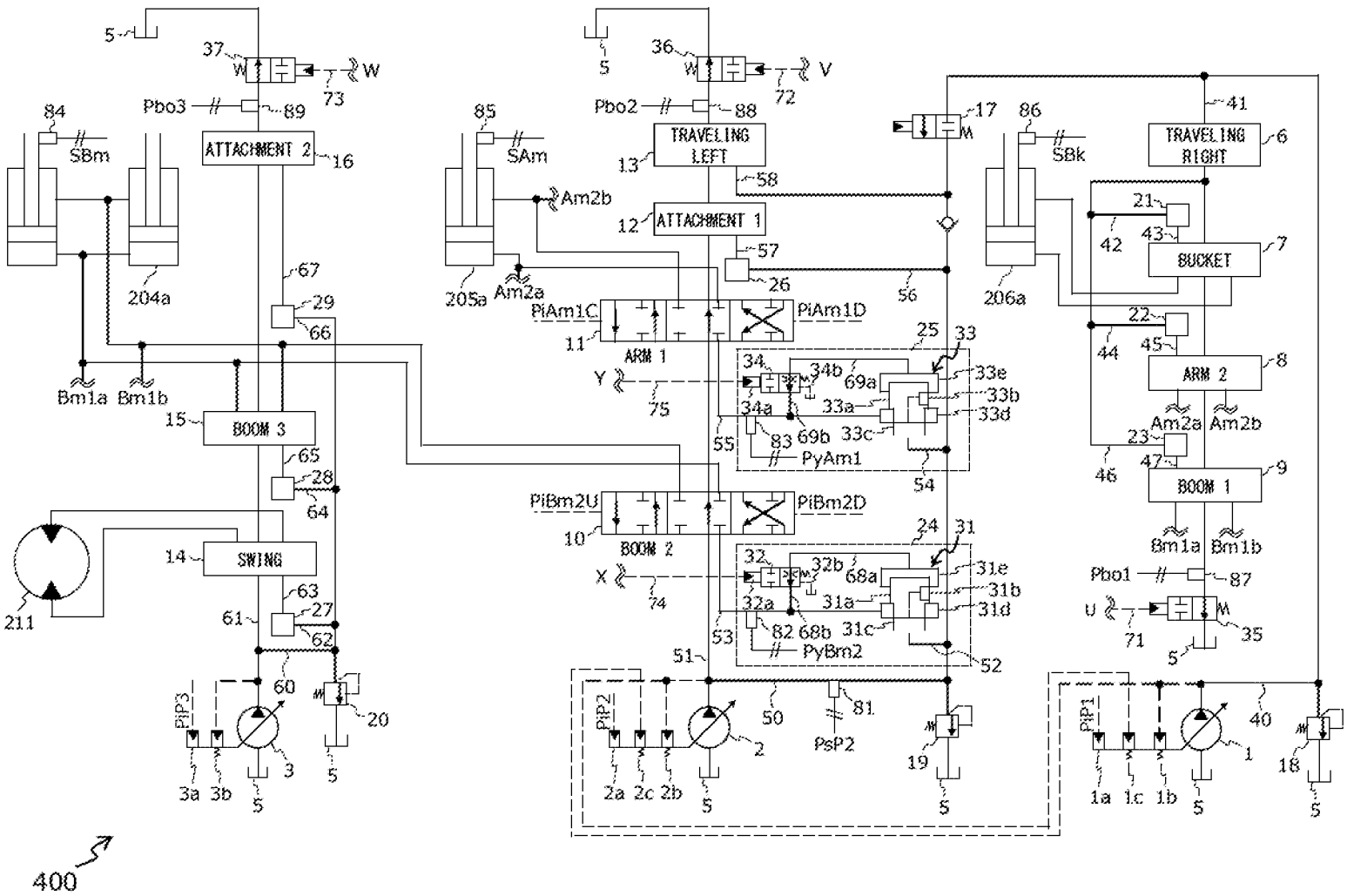
FIG. 2A is a circuit diagram (1/2) of a hydraulic drive system included in the hydraulic excavator depicted in FIG. 1.
Figure 2B:
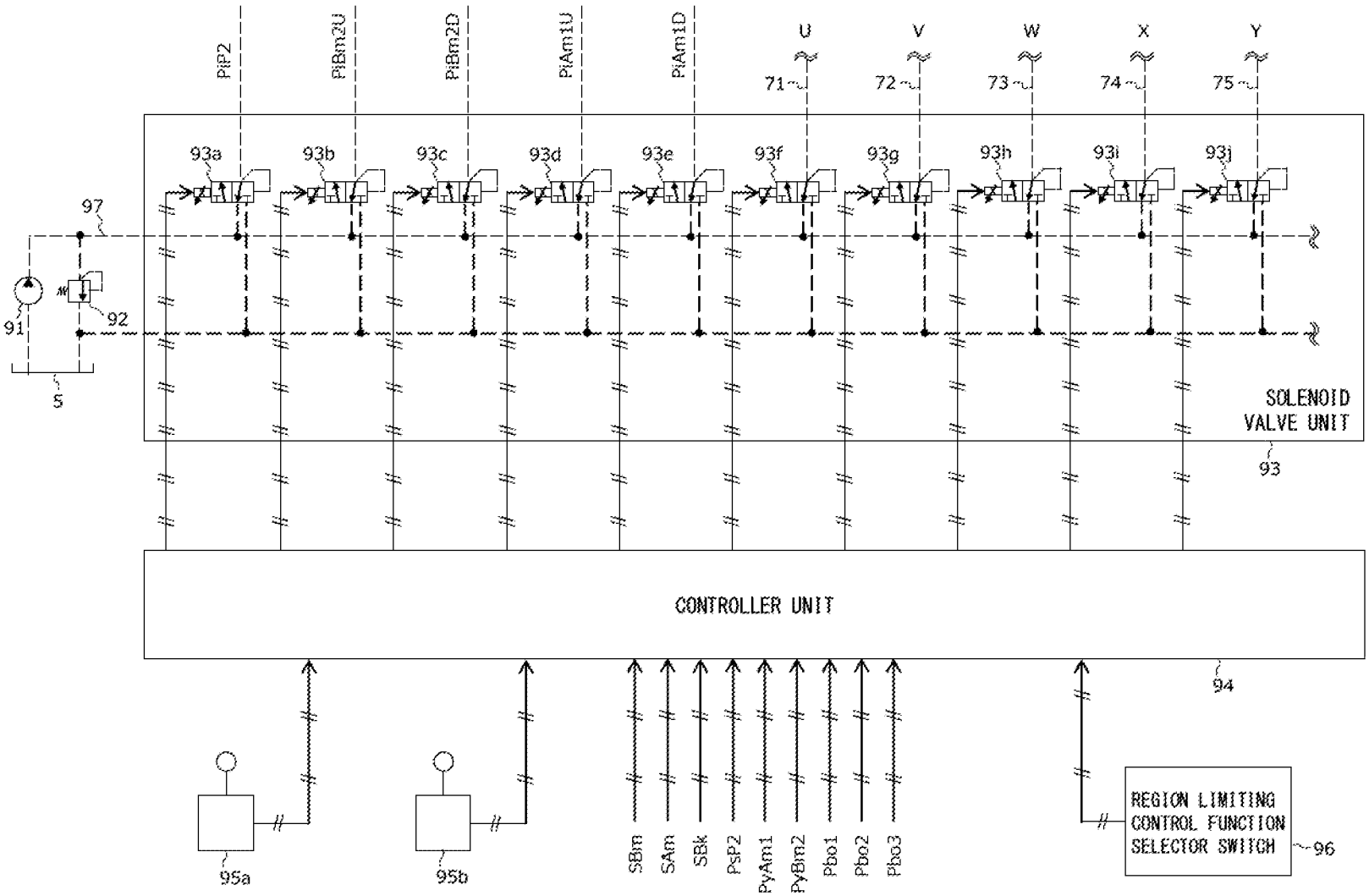
FIG. 2B is a circuit diagram (2/2) of the hydraulic drive system included in the hydraulic excavator depicted in FIG. 1.

FIG. 2A and FIG. 2B are circuit diagrams of a hydraulic drive system in a first embodiment of the present invention.

(1) Configuration

The hydraulic drive system 400 in the first embodiment includes three main hydraulic pumps driven by the engine (not depicted), for example, a first hydraulic pump 1, a second hydraulic pump 2, and a third hydraulic pump 3 each constituted by a variable displacement type hydraulic pump. In addition, the hydraulic drive system 400 includes a pilot pump 91 driven by the engine and includes a hydraulic fluid tank 5 that supplies oil to the hydraulic pumps 1 to 3 and the pilot pump 91.

The tilting angle of the first hydraulic pump 1 is controlled by a regulator attached to the first hydraulic pump 1. The regulator of the first hydraulic pump 1 includes a flow rate control command pressure port 1*a*, a first hydraulic pump self-pressure port 1*b*, and a second hydraulic pump self-pressure port 1*c*. The tilting angle of the second hydraulic pump 2 is controlled by a regulator attached to the second hydraulic pump 2. The regulator of the second hydraulic pump 2 includes a flow rate control command pressure port 2*a*, a second hydraulic pump self-pressure port 2*b*, and a first hydraulic pump self-pressure port 2*c*. The tilting angle of the third hydraulic pump 3 is controlled by a regulator attached to the third hydraulic pump 3. The regulator of the third hydraulic pump 3 includes a flow rate control command pressure port 3*a* and a third hydraulic pump self-pressure port 3*b*.

A delivery line 40 of the first hydraulic pump 1 is connected to the hydraulic fluid tank 5 via a center bypass hydraulic fluid line 41. Arranged on the center bypass hydraulic fluid line 41 are, in order from an upstream side, a right travelling directional control valve 6 that controls the driving of a right travelling motor, not depicted, of a pair of travelling motors for driving the track structure 201, a bucket directional control valve 7 that controls a flow of hydraulic fluid supplied to the bucket cylinder 206*a*, a second arm directional control valve 8 that controls a flow of hydraulic fluid supplied to the arm cylinder 205*a*, a first boom directional control valve 9 that controls a flow of hydraulic fluid supplied to the boom cylinder 204*a*, and a bleed-off valve 35. Respective supply ports of the bucket directional control valve 7, the second arm directional control valve 8, and the first boom directional control valve 9 are connected in parallel to part of the center bypass hydraulic fluid line 41 which connects the right travelling directional control valve 6 and the bucket directional control valve 7 to each other via hydraulic fluid lines 42 and 43, hydraulic fluid lines 44 and 45, and hydraulic fluid lines 46 and 47, respectively. In addition, the delivery line 40 is connected to the hydraulic fluid tank 5 via a main relief valve 18 in order to protect the circuit from an excessive rise in pressure. The delivery line 40 is provided with a pressure sensor (not depicted) that detects the pressure of the first hydraulic pump 1. A pressure sensor 87 that detects a differential pressure across the bleed-off valve 35 is provided upstream of the bleed-off valve 35 on the center bypass hydraulic fluid line 41.

A delivery line 50 of the second hydraulic pump 2 is connected to the hydraulic fluid tank 5 via a center bypass hydraulic fluid line 51 and is connected to the delivery line 40 of the first hydraulic pump 1 via a confluence valve 17. Arranged on the center bypass hydraulic fluid line 51 are, in order from an upstream side, a second boom directional control valve 10 that controls a flow of hydraulic fluid supplied to the boom cylinder 204*a*, a first arm directional control valve 11 that controls a flow of hydraulic fluid supplied to the arm cylinder 205*a*, a first attachment directional control valve 12 that controls a flow of hydraulic fluid supplied to a first actuator, not depicted, for driving, for example, a first special attachment such as a pulverizer provided in place of the bucket 206, a left travelling directional control valve 13 that controls the driving of a left travelling motor, not depicted, of the pair of travelling motors for driving the track structure 201, and a bleed-off valve 36. Respective supply ports of the second boom directional control valve 10, the first arm directional control valve 11, the first attachment directional control valve 12, and the left travelling directional control valve 13 are connected in parallel to the delivery line 50 of the second hydraulic pump 2 via hydraulic fluid lines 52 and 53, hydraulic fluid lines 54 and 55, hydraulic fluid lines 56 and 57, and a hydraulic fluid line 58, respectively. In addition, the delivery line 50 is connected to the hydraulic fluid tank 5 via a main relief valve 19 in order to protect the circuit from an excessive rise in pressure. The delivery line 50 is provided with a pressure sensor 81 that detects the pressure of the second hydraulic pump 2. A pressure sensor 88 that detects a differential pressure across the bleed-off valve 36 is provided upstream of the bleed-off valve 36 on the center bypass hydraulic fluid line 51.

A delivery line 60 of the third hydraulic pump 3 is connected to the hydraulic fluid tank 5 via a center bypass hydraulic fluid line 61. Arranged on the center bypass hydraulic fluid line 61 are, in order from an upstream side, a swing directional control valve 14 that controls a flow of hydraulic fluid supplied to the swing motor 211 for driving the swing structure 202, a third boom directional control valve 15 that controls a flow of hydraulic fluid supplied to the boom cylinder 204*a*, a second attachment directional control valve 16, and a bleed-off valve 37. When a second special attachment provided with a second actuator in addition to the first special attachment is fitted, or when the second special attachment provided with two actuators, that is, the first actuator and the second actuator, in place of a first special actuator, is fitted, the second attachment directional control valve 16 is used to control a flow of hydraulic fluid supplied to the second actuator. Respective supply ports of the swing directional control valve 14, the third boom directional control valve 15, and the second attachment directional control valve 16 are connected in parallel to the delivery line 60 of the third hydraulic pump 3 via hydraulic fluid lines 62 and 63, hydraulic fluid lines 64 and 65, and hydraulic fluid lines 66 and 67, respectively. In addition, the delivery line 60 is connected to the hydraulic fluid tank 5 via a main relief valve 20 in order to protect the circuit from an excessive rise in pressure. The delivery line 60 is provided with a pressure sensor (not depicted) that detects the pressure of the third hydraulic pump 3. A pressure sensor 89 that detects a differential pressure across the bleed-off valve 37 is provided upstream of the bleed-off valve 37 on the center bypass hydraulic fluid line 61.

The boom cylinder 204*a*, the arm cylinder 205*a*, and the bucket cylinder 206*a* are respectively provided with stroke sensors 84, 85, and 86 that detect a stroke amount with an objective of obtaining the operation state of the hydraulic excavator 300. Incidentally, means for obtaining the operation state of the hydraulic excavator 300 is various, such as inclination sensors, rotation angle sensors, or IMUs, and is not limited to the above-described stroke sensors.

The hydraulic fluid lines 42 and 43 connected to the bucket directional control valve 7, the hydraulic fluid lines 44 and 45 connected to the second arm directional control valve 8, and the hydraulic fluid lines 46 and 47 connected to the first boom directional control valve 9 are respectively provided with auxiliary flow rate control valves 21, 22, and 23 that limit the flow rate of the hydraulic fluid supplied from the first hydraulic pump 1 to each directional control valve at a time of a combined operation. The hydraulic fluid lines 52 and 53 connected to the supply port of the second boom directional control valve 10, the hydraulic fluid lines 54 and 55 connected to the supply port of the first arm directional control valve 11, and the hydraulic fluid lines 56 and 57 connected to the supply port of the first attachment directional control valve 12 are respectively provided with auxiliary flow rate control valves 24, 25, and 26 that limit the flow rate of the hydraulic fluid supplied from the second hydraulic pump 2 to each directional control valve at the time of the combined operation. The hydraulic fluid lines 62 and 63 connected to the supply port of the swing directional control valve 14, the hydraulic fluid lines 64 and 65 connected to the supply port of the third boom directional control valve 15, and the hydraulic fluid lines 66 and 67 connected to the supply port of the second attachment directional control valve 16 are respectively provided with auxiliary flow rate control valves 27, 28, and 29 that limit the flow rate of the hydraulic fluid supplied from the third hydraulic pump 3 to each directional control valve at the time of the combined operation.

A delivery port of the pilot pump 91 is connected to the hydraulic fluid tank 5 via a pilot relief valve 92 for generation of a pilot primary pressure, and is connected to one input ports of solenoid proportional valves 93*a* to 93*j* included in a solenoid valve unit 93 via a hydraulic fluid line 97. Other input ports of the solenoid proportional valves 93*a* to 93*j* are connected to the hydraulic fluid tank 5. The solenoid proportional valves 93*a* to 93*j* each reduce the pilot primary pressure according to a command signal from a controller 94, and thereby generate a pilot command pressure.

An output port of the solenoid proportional valve 93*a* is connected to the flow rate control command pressure port 2*a* of the regulator of the second hydraulic pump 2. Output ports of the solenoid proportional valves 93*b* and 93*c* are connected to pilot ports of the second boom directional control valve 10. Output ports of the solenoid proportional valves 93*d* and 93*e* are connected to pilot ports of the first arm directional control valve 11. The solenoid proportional valve 93*f* is connected to a pilot port of the bleed-off valve 35 via a hydraulic fluid line 71. The solenoid proportional valve 93*g* is connected to a pilot port of the bleed-off valve 36 via a hydraulic fluid line 72. The solenoid proportional valve 93*h* is connected to a pilot port of the bleed-off valve 37 via a hydraulic fluid line 73. The solenoid proportional valve 93*i* is connected to the auxiliary flow rate control valve 24 via a hydraulic fluid line 74. The solenoid proportional valve 93*j* is connected to the auxiliary flow rate control valve 25 via a hydraulic fluid line 75.

Incidentally, for simplification of the description, the following are not depicted: solenoid proportional valves for the flow rate control command pressure ports 1*a* and 3*a* of the regulators of the first hydraulic pump 1 and the third hydraulic pump 3, solenoid proportional valves for the right travelling directional control valve 6, solenoid proportional valves for the bucket directional control valve 7, solenoid proportional valves for the second arm directional control valve 8, solenoid proportional valves for the first boom directional control valve 9, solenoid proportional valves for the first attachment directional control valve 12, solenoid proportional valves for the left travelling directional control valve 13, solenoid proportional valves for the swing directional control valve 14, solenoid proportional valves for the third boom directional control valve 15, solenoid proportional valves for the second attachment directional control valve 16, and solenoid proportional valves for the auxiliary flow rate control valves 21 to 23 and 26 to 29.

The auxiliary flow rate control valve 24 includes a seat type main valve 31 that forms an auxiliary variable restrictor, a control variable restrictor 31*b* that is provided to a valve body 31*a* of the main valve 31 and that changes an opening amount according to an amount of movement of the valve body 31*a*, and a pilot variable restrictor 32. A housing including the main valve 31 has a first pressure chamber 31*c* formed in a connecting portion of the main valve 31 and the hydraulic fluid line 52, a second pressure chamber 31*d* formed in a connecting portion of the main valve 31 and the hydraulic fluid line 53, and a third pressure chamber 31*e* formed so as to communicate with the first pressure chamber 31*c* via the control variable restrictor 31*b*. The third pressure chamber 31*e* and the pilot variable restrictor 32 are connected to each other by a hydraulic fluid line 68*a*. The pilot variable restrictor 32 and the hydraulic fluid line 53 are connected to each other by a hydraulic fluid line 68*b*. A pilot port 32*a* of the pilot variable restrictor 32 is connected to an output port of the solenoid proportional valve 93*i*. A pressure sensor 82 is provided to the hydraulic fluid line 53 that connects the second boom directional control valve 10 and the auxiliary flow rate control valve 24 (main valve 33) to each other. Incidentally, though partly not depicted for simplification of the description, the auxiliary flow rate control valves 21 to 29 and peripheral apparatuses, piping, and wiring all have same configurations.

The hydraulic drive system 400 has a control lever 95*a* capable of performing switching operation on the first boom directional control valve 9, the second boom directional control valve 10, and the third boom directional control valve 15 and a control lever 95*b* capable of performing switching operation on the first arm directional control valve 11 and the second arm directional control valve 8. Incidentally, for simplification of the description, the following are not depicted: a right travelling control lever that performs switching operation on the right travelling directional control valve 6, a bucket control lever that performs switching operation on the bucket directional control valve 7, a first attachment control lever that performs switching operation on the first attachment directional control valve 12, a left travelling control lever that performs switching operation on the left travelling directional control valve 13, a swing control lever that performs switching operation on the swing directional control valve 14, and a second attachment control lever that performs switching operation on the second attachment directional control valve 16.

The hydraulic drive system 400 includes the controller 94. Output signals of the control levers 95*a* and 95*b*, output signals of the pressure sensors 81 to 83 and 87 to 89, and output signals of the stroke sensors 84 to 86 are inputted to the controller 94. In addition, the controller 94 outputs command signals to the solenoid proportional valves 93*a* to 93*j* of the solenoid valve unit 93 (including the solenoid proportional valves not depicted).

Figure 3:
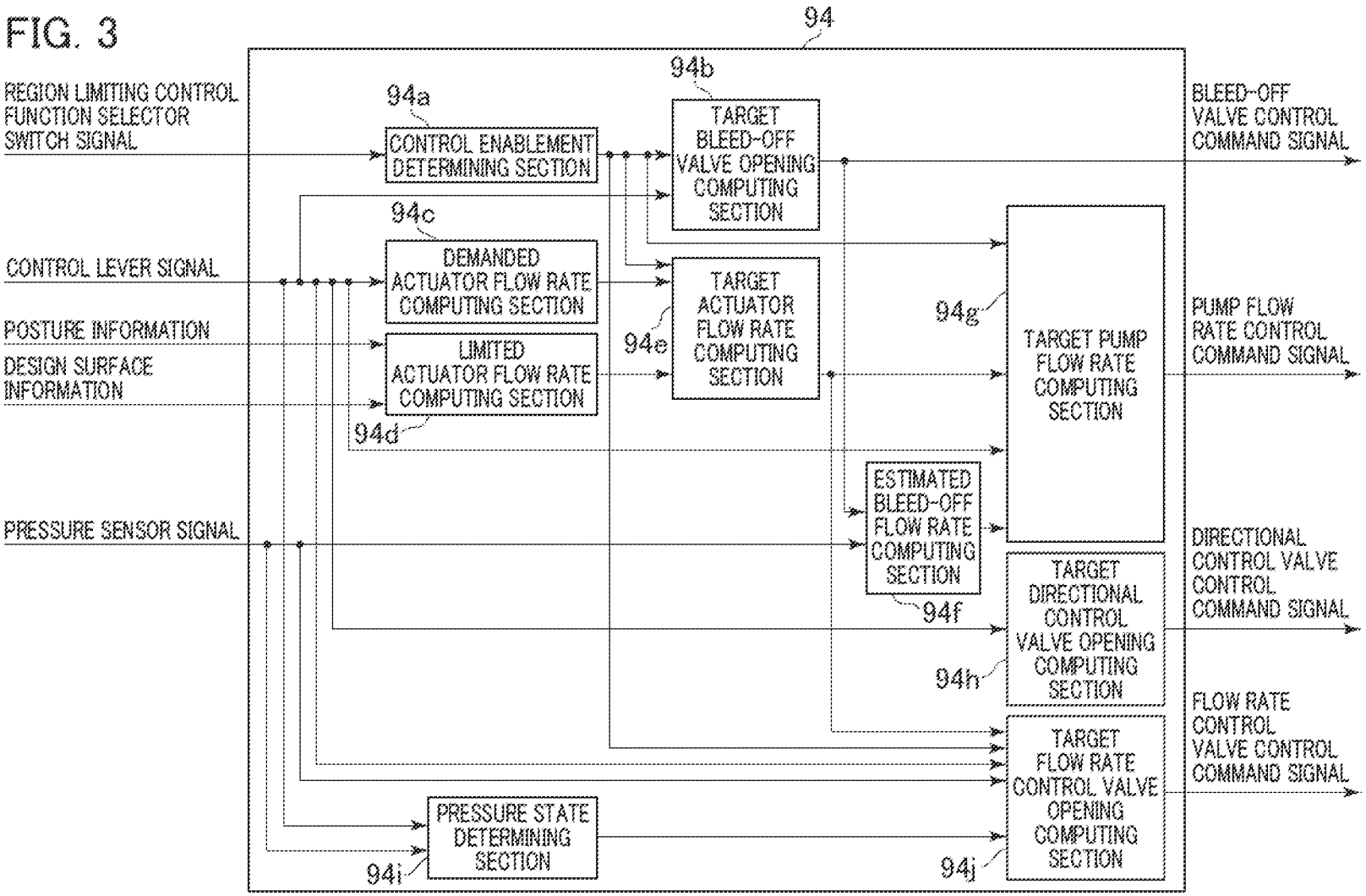
FIG. 3 is a functional block diagram of a controller depicted in FIG. 2B.

FIG. 3 is a functional block diagram of the controller 94. In FIG. 3, the controller 94 includes a control enablement determining section 94*a*, a target bleed-off valve opening computing section 94*b*, a demanded actuator flow rate computing section 94*c*, a limited actuator flow rate computing section 94*d*, a target actuator flow rate computing section 94*e*, an estimated bleed-off flow rate computing section 94*f*, a target pump flow rate computing section 94*g*, a target directional control valve opening computing section 94*h*, a pressure state determining section 94*i*, and a target flow rate control valve opening computing section 94*j*.

The control enablement determining section 94*a* determines whether a region limiting control function is enabled or disabled on the basis of a signal of a region limiting control function selector switch 96. The target bleed-off valve opening computing section 94*b* calculates target opening amounts of the bleed-off valves 35 to 37 on the basis of a result of the determination of the control enablement determining section 94*a* and signals of the control levers 95*a* and 95*b*, and outputs command signals corresponding to the target opening amounts to the solenoid proportional valves 93*f* to 93*h*.

The demanded actuator flow rate computing section 94*c* calculates demanded flow rates of actuators on the basis of the signals of the control levers 95*a* and 95*b*. The limited actuator flow rate computing section 94*d* calculates, as limited flow rates, actuator flow rates for performing control such that the machine body 202 or the work device 104 does not deviate from a set limited region on the basis of the posture information of the machine body 202 or the work device 104 which is obtained from signals of the stroke sensors 84 to 86 or the like and preset design surface information.

The target actuator flow rate computing section 94*e* calculates target flow rates to be supplied to the actuators on the basis of the determination result of the control enablement determining section 94*a*, the demanded flow rates of the actuators from the demanded actuator flow rate computing section 94*c*, and the limited flow rates of the actuators from the limited actuator flow rate computing section 94*d*. The estimated bleed-off flow rate computing section 94*f* calculates passing flow rates (estimated bleed-off flow rates) of the bleed-off valves 35 to 37 on the basis of the target opening amounts of the bleed-off valves 35 to 37 from the target bleed-off valve opening computing section 94*b* and differential pressures across the bleed-off valves 35 to 37 which are obtained from output signals of the pressure sensors 87 to 89.

The target pump flow rate computing section 94*g* calculates target flow rates (target pump flow rates) of the hydraulic pumps 1 to 3 on the basis of the determination result of the control enablement determining section 94*a*, the target flow rates of the actuators from the target actuator flow rate computing section 94*e*, lever operation amounts obtained from the signals of the control levers 95*a* and 95*b*, and the estimated bleed-off flow rates from the estimated bleed-off flow rate computing section 94*f*. The target pump flow rate computing section 94*g* outputs a command signal corresponding to the target pump flow rates to the solenoid proportional valve 93*a*. The target directional control valve opening computing section 94*h* calculates target opening amounts of directional control valves on the basis of the lever operation amounts obtained from the signals of the control levers 95*a* and 95*b*, and outputs command signals corresponding to the target opening amounts to 93*b* to 93*e*.

The pressure state determining section 94*i* calculates differential pressures across the auxiliary flow rate control valves (main valves) corresponding to actuators as operation targets on the basis of the signals of the control levers 95*a* and 95*b* and the pressure sensors 81 to 83, and selects a minimum value of these differential pressures (minimum across differential pressure). The target flow rate control valve opening computing section 94*j* calculates target opening amounts of the auxiliary flow rate control valves (main valves) on the basis of the determination result of the control enablement determining section 94*a*, the target flow rates of the actuators from the target actuator flow rate computing section 94*e*, the signals of the control levers 95*a* and 95*b*, the signals of the pressure sensors 81 to 83, the differential pressures across the auxiliary flow rate control valves (main valves) corresponding to the actuators as operation targets from the pressure state determining section 94*i*, and the minimum across differential pressure from the pressure state determining section 94*i*. The target flow rate control valve opening computing section 94*j* outputs command signals corresponding to the target opening amounts to the solenoid proportional valves 93*i* and 93*j*.

Figure 4:
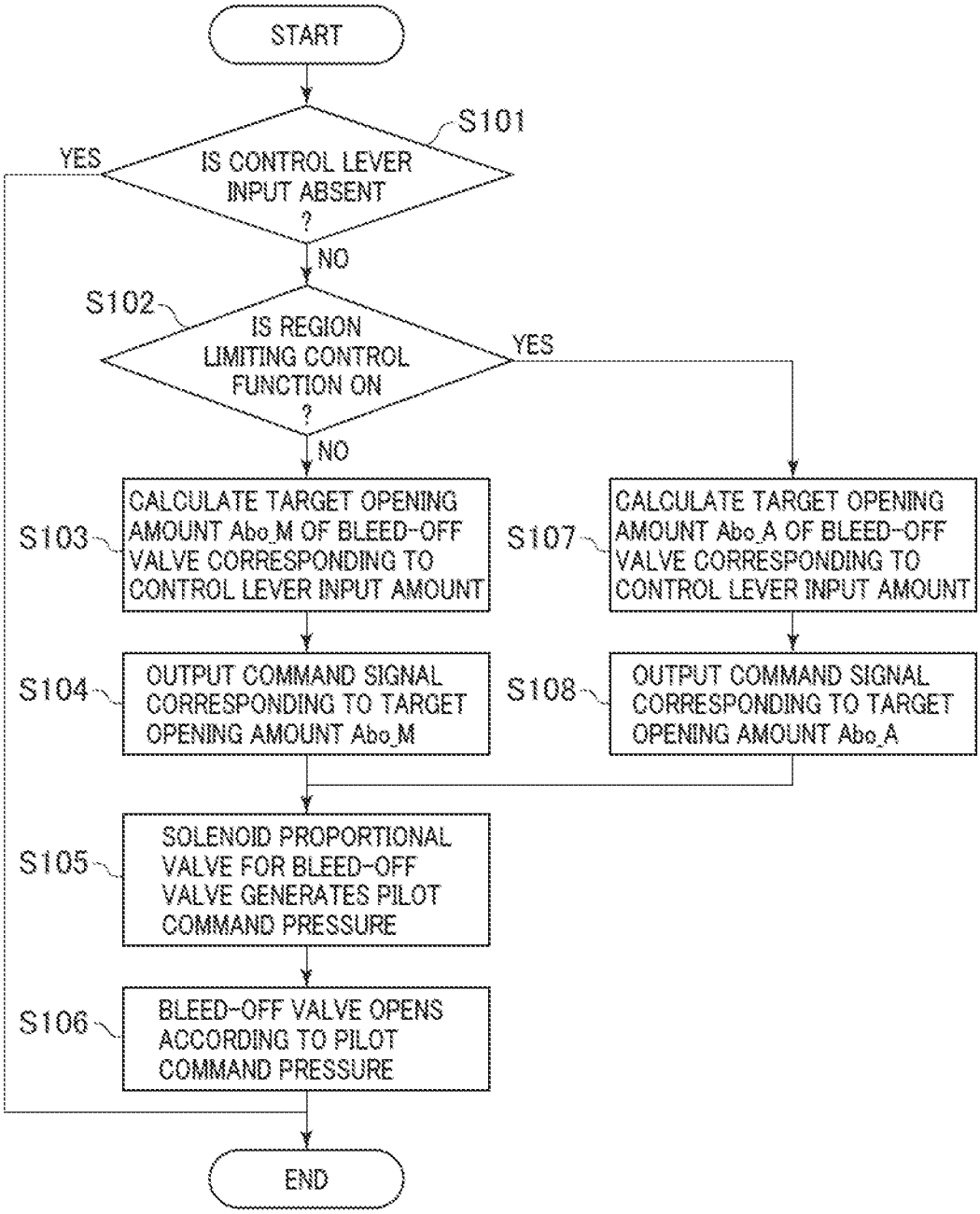
FIG. 4 is a flowchart indicating processing related to control on bleed-off valves by the controller depicted in FIG. 2B.

FIG. 4 is a flowchart showing processing related to control on the bleed-off valves 35 to 37 by the controller 94. In the following, description will be made of only the processing related to the bleed-off valve 36. The processing related to the other bleed-off valves is similar to this, and therefore, description thereof will be omitted.

The controller 94 first determines whether or not input of control levers is absent (step S101). The control levers in this case refer to the control levers corresponding to the directional control valves 10 to 13 arranged upstream of the bleed-off valve 36. When the controller 94 determines in step S101 that there is no control lever input (YES), the controller 94 ends the flow. The bleed-off valve 36 is thereby set in a fully opened state.

When the controller 94 determines in step S101 that there is control lever input (NO), the controller 94 determines whether or not the region limiting control function is enabled (step S102).

When the controller 94 determines in step S102 that the region limiting control function is disabled (NO), the target bleed-off valve opening computing section 94*b* of the controller 94 calculates a target opening amount Abo_M of the bleed-off valve 36 which corresponds to a control lever input amount (S103). The control lever input amount in this case refers to a maximum value of control lever input amounts corresponding to the directional control valves 10 to 13 arranged upstream of the bleed-off valve 36.

Following step S103, the controller 94 outputs a command signal corresponding to the target opening amount Abo_M to the solenoid proportional valve 93*g* for the bleed-off valve 36 from the controller 94 (S104), makes the solenoid proportional valve 93*g* generate a pilot command pressure of the bleed-off valve 36 (S105), makes the bleed-off valve 36 open according to the pilot command pressure (S106), and then ends the flow.

When the controller 94 determines in step S102 that the region limiting control function is enabled (YES), the target bleed-off valve opening computing section 94*b* of the controller 94 calculates a target opening amount Abo_A of the bleed-off valve 36 which corresponds to the control lever input amount (S107).

Following step S110, the controller 94 outputs a command signal corresponding to the target opening amount Abo_A from the controller 94 to the solenoid proportional valve 93*g* for the bleed-off valve 36 (S108), performs the processing of steps S105 and S106, and thereafter ends the flow.

Figure 5:
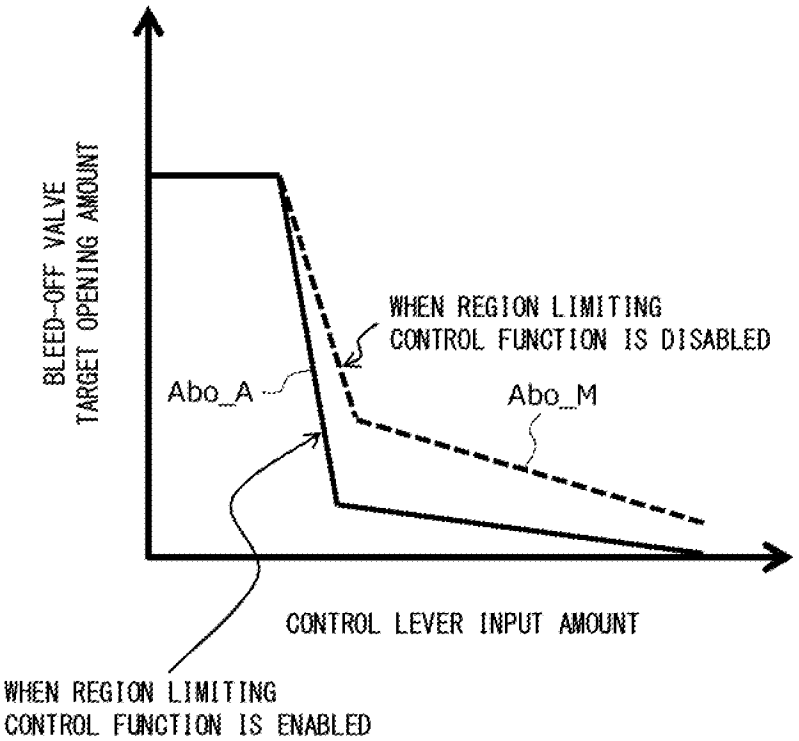
FIG. 5 is a diagram indicating a relation between a control lever input amount and bleed-off valve target opening amounts.

FIG. 5 indicates a relation between the control lever input amount and the target opening amounts Abo_M and Abo_A of the bleed-off valves 35 to 37. In FIG. 5, the target opening amount Abo_M when the region limiting control function is disabled is set so as to be a maximum opening amount when the control lever input amount is equal to or less than a predetermined input amount and set so as to decrease according to increase in the input amount when the control lever input amount exceeds the predetermined input amount. The target opening amount Abo_A when the region limiting control function is enabled is also similarly set so as to be the maximum opening amount when the control lever input amount is equal to or less than the predetermined input amount and set so as to decrease according to increase in the input amount when the control lever input amount exceeds the predetermined input amount. Here, the target opening amount Abo_A when the control lever input amount exceeds the predetermined input amount is set so as to be smaller than the target opening amount Abo_M when the region limiting control function is disabled. Incidentally, as opening characteristics of the bleed-off valve with respect to the control lever input amount, various opening characteristics other than the opening characteristics depicted in the figure are also used in order for a designer to obtain desired hydraulic system control characteristics.

Figure 6A:
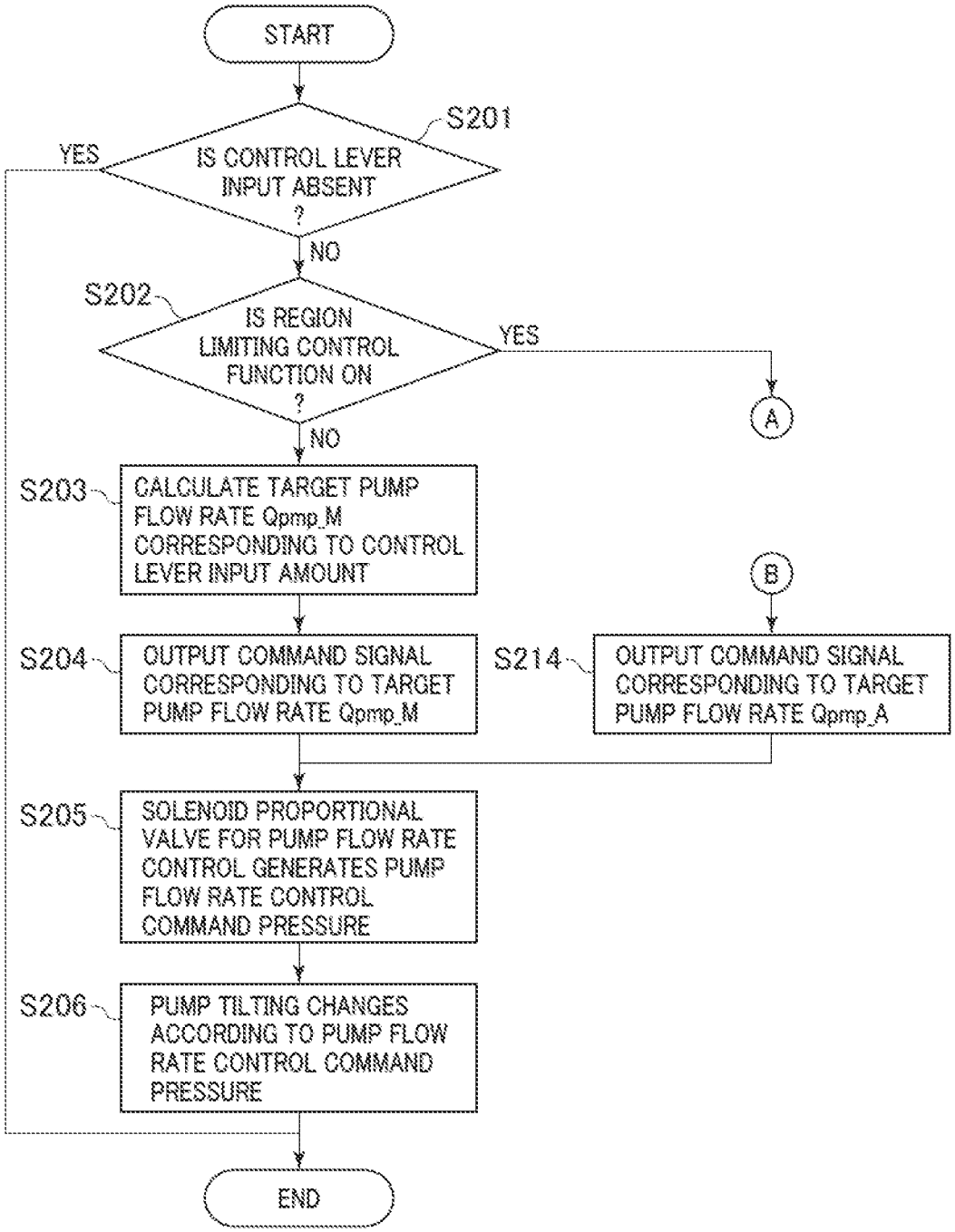
FIG. 6A is a flowchart (1/2) indicating processing related to pump flow rate control of the controller depicted in FIG. 2B.
Figure 6B:
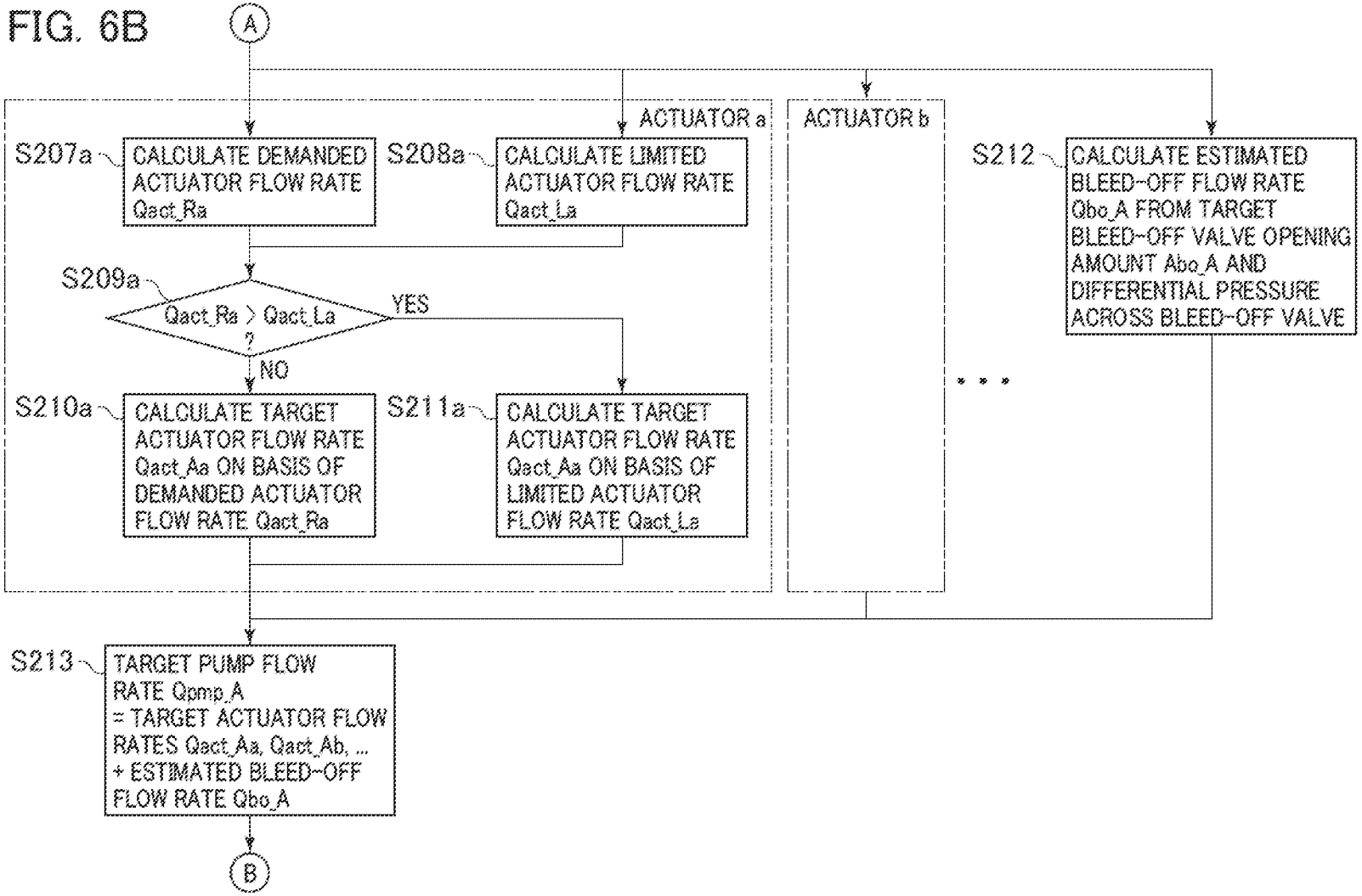
FIG. 6B is a flowchart (2/2) indicating the processing related to the pump flow rate control of the controller depicted in FIG. 2B.

FIG. 6A and FIG. 6B are flowcharts indicating processing related to flow rate control on the hydraulic pumps 1 to 3 by the controller 94. In the following, description will be made of only the processing related to the flow rate control on the second hydraulic pump 2. The processing related to the flow rate control on the other hydraulic pumps is similar to this, and therefore, description thereof will be omitted.

The controller 94 first determines whether or not control lever input is absent (step S201). When the controller 94 determines in step S201 that there is no control lever input (YES), the controller 94 ends the flow.

When the controller 94 determines in step S201 that there is control lever input (NO), the controller 94 determines whether or not the region limiting control function is enabled (step S202).

When the controller 94 determines in step S202 that the region limiting control function is disabled (NO), the target pump flow rate computing section 94*g* of the controller 94 calculates a target flow rate Qpmp_M of the second hydraulic pump 2 which corresponds to the control lever input amount (S203), outputs a command signal corresponding to the target flow rate Qpmp_M to the solenoid proportional valve 93*a* for the flow rate control on the second hydraulic pump 2 (S204), makes the solenoid proportional valve 93*a* generate a flow rate control command pressure of the second hydraulic pump 2 (S205), makes the tilting of the second hydraulic pump 2 change according to the flow rate control command pressure (S206), and then ends the flow.

When the controller 94 determines in step S202 that the region limiting control function is enabled (YES), the demanded actuator flow rate computing section 94*c* of the controller 94 calculates a demanded flow rate Qact_Ra of an actuator a which corresponds to the control lever input amount (S207*a*). At the same time, the limited actuator flow rate computing section 94*d* of the controller 94 calculates a limited flow rate Qact_La of the actuator from the posture information and the design surface information (S208*a*). Next, the controller 94 determines whether or not the demanded flow rate Qact_Ra of the actuator is larger than the limited flow rate Qact_La (step S209*a*).

When the controller 94 determines in step S209*a* that the demanded flow rate Qact_Ra of the actuator is equal to or less than the limited flow rate Qact_La (NO), the target actuator flow rate computing section 94*e* of the controller 94 calculates a target flow rate Qact_Aa of the actuator on the basis of the demanded flow rate Qact_Ra of the actuator (step S210*a*).

When the controller 94 determines in step S209*a* that the demanded flow rate Qact_Ra of the actuator is larger than the limited flow rate Qact_La (YES), the target actuator flow rate computing section 94*e* of the controller 94 calculates the target flow rate Qact_Aa of the actuator on the basis of the limited flow rate Qact_La of the actuator (step S211*a*).

Incidentally, though partly not depicted in FIG. 6B, the above-described calculation processing is performed for all of the actuators a, b, . . . supplied with the hydraulic fluid from the second hydraulic pump 2, and thereby the target flow rates Qact_Aa, Qact_Ab, . . . of the respective actuators are calculated.

In addition, in parallel with the above-described processing, the estimated bleed-off flow rate computing section 94*f* of the controller 94 calculates an estimated bleed-off flow rate Qbo_A on the basis of the target opening amount Abo_A of the bleed-off valve 36 and the differential pressure across the bleed-off valve 36 which is obtained from the signal of the pressure sensor 88 (step S212).

Figure 7:
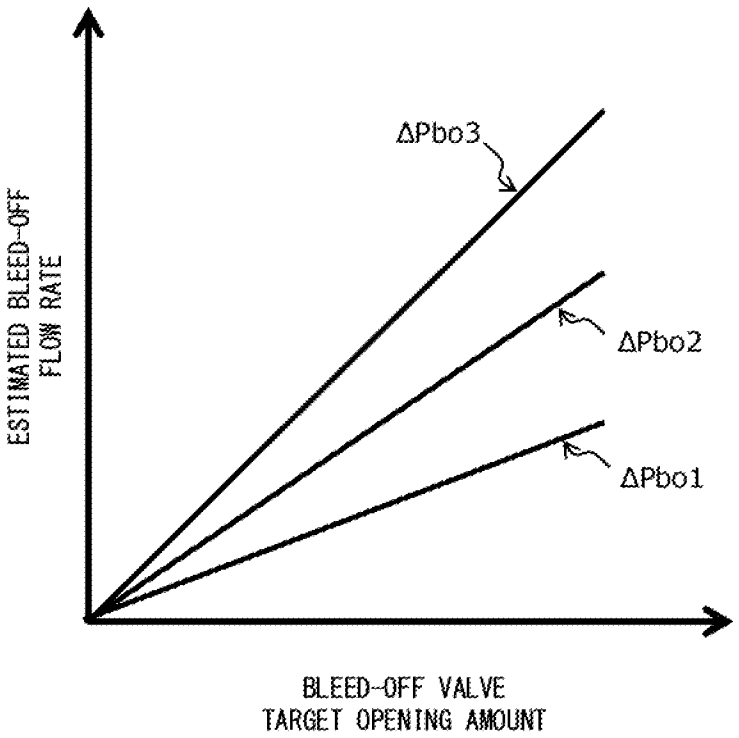
FIG. 7 is a diagram indicating a relation between a bleed-off valve target opening amount and an estimated bleed-off flow rate.

FIG. 7 indicates a relation between the target opening amount and the estimated bleed-off flow rate of each of the bleed-off valves 35 to 37. A plurality of flow rate characteristics of the bleed-off valves 35 to 37 are set according to the differential pressure across each of the bleed-off valves 35 to 37. An appropriate flow rate characteristic is selected when the estimated bleed-off flow rate is calculated. FIG. 7 indicates flow rate characteristics for across differential pressures ΔPbo1, ΔPbo2, and ΔPbo3 (ΔPbo1<ΔPbo2<ΔPbo3). The estimated bleed-off flow rate is increased as the target opening amount of each of the bleed-off valves 35 to 37 is increased. In addition, as the differential pressure across each of the bleed-off valves 35 to 37 is increased, a degree of increase in the estimated bleed-off flow rate with respect to the target opening amount is increased. Here, various flow rate characteristics other than the flow rate characteristics depicted in the figure are also used as characteristics of the estimated bleed-off flow rate with respect to the target opening amount of the bleed-off valve in order for the designer to obtain desired hydraulic system control characteristics. In addition, the characteristic of the estimated bleed-off flow rate may be set in consideration of an effect of another factor affecting the flow rate characteristic of the bleed-off valve, such as oil temperature. In addition, in calculating the estimated bleed-off flow rate, other than the method of selecting one of the preset plurality of flow rate characteristics, there may be adopted a method which generates a new flow rate characteristic by performing interpolation or extrapolation on the preset plurality of flow rate characteristics.

Following steps S210*a*, S211*a*, . . . , S212, the target pump flow rate computing section 94*g* of the controller 94 calculates a sum of the target flow rates Qact_Aa, Qact_Ab, . . . of the respective actuators and the estimated bleed-off flow rate Qbo_A as a target pump flow rate Qpmp_A (step S213).

Following step S213, the controller 94 outputs a command signal corresponding to the target pump flow rate Qpmp_A from the controller 94 to the solenoid proportional valve 93*a* for the flow rate control on the second hydraulic pump 2 (S214), performs the processing of steps S205 and S206, and thereafter ends the flow.

Figure 8:
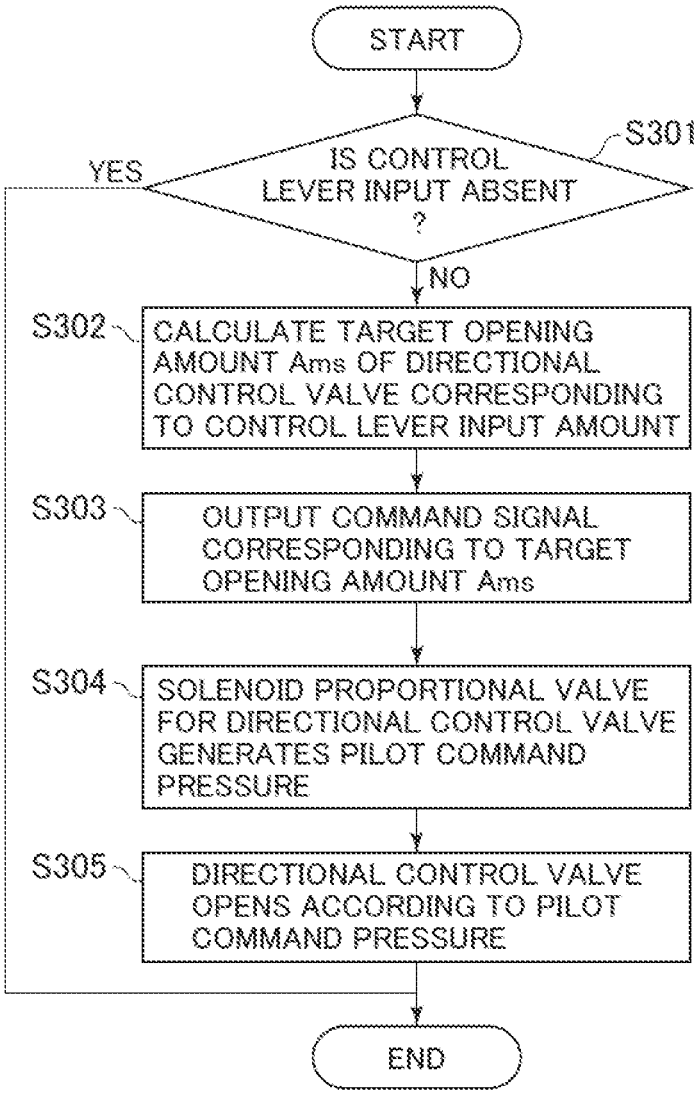
FIG. 8 is a flowchart indicating processing related to control on directional control valves by the controller depicted in FIG. 2B.

FIG. 8 is a flowchart indicating processing related to control on the directional control valves 6 to 16 by the controller 94. In the following, description will be made of only the processing related to the second boom directional control valve 10. The processing related to the other directional control valves is similar to this, and therefore, description thereof will be omitted.

The controller 94 first determines whether or not input of the boom control lever 95*a* is absent (step S301). When the controller 94 determines in step S301 that input of the boom control lever 95*a* is absent (YES), the controller 94 ends the flow.

When the controller 94 determines in step S301 that there is input of the boom control lever 95*a* (NO), the target directional control valve opening computing section 94*h* of the controller 94 calculates a target opening amount Ams of the directional control valve 10 which corresponds to an input amount of the boom control lever 95*a* (step S302).

Following step S302, the controller 94 outputs command signals corresponding to the target opening amount Ams from the controller 94 to the solenoid proportional valves 93*b* and 93*c* for the directional control valve 10 (S303), makes the solenoid proportional valves 93*b* and 93*c* generate pilot command pressures of the directional control valve 10 (S304), makes the directional control valve 10 open according to the pilot command pressures (S305), and then ends the flow.

Figure 9:
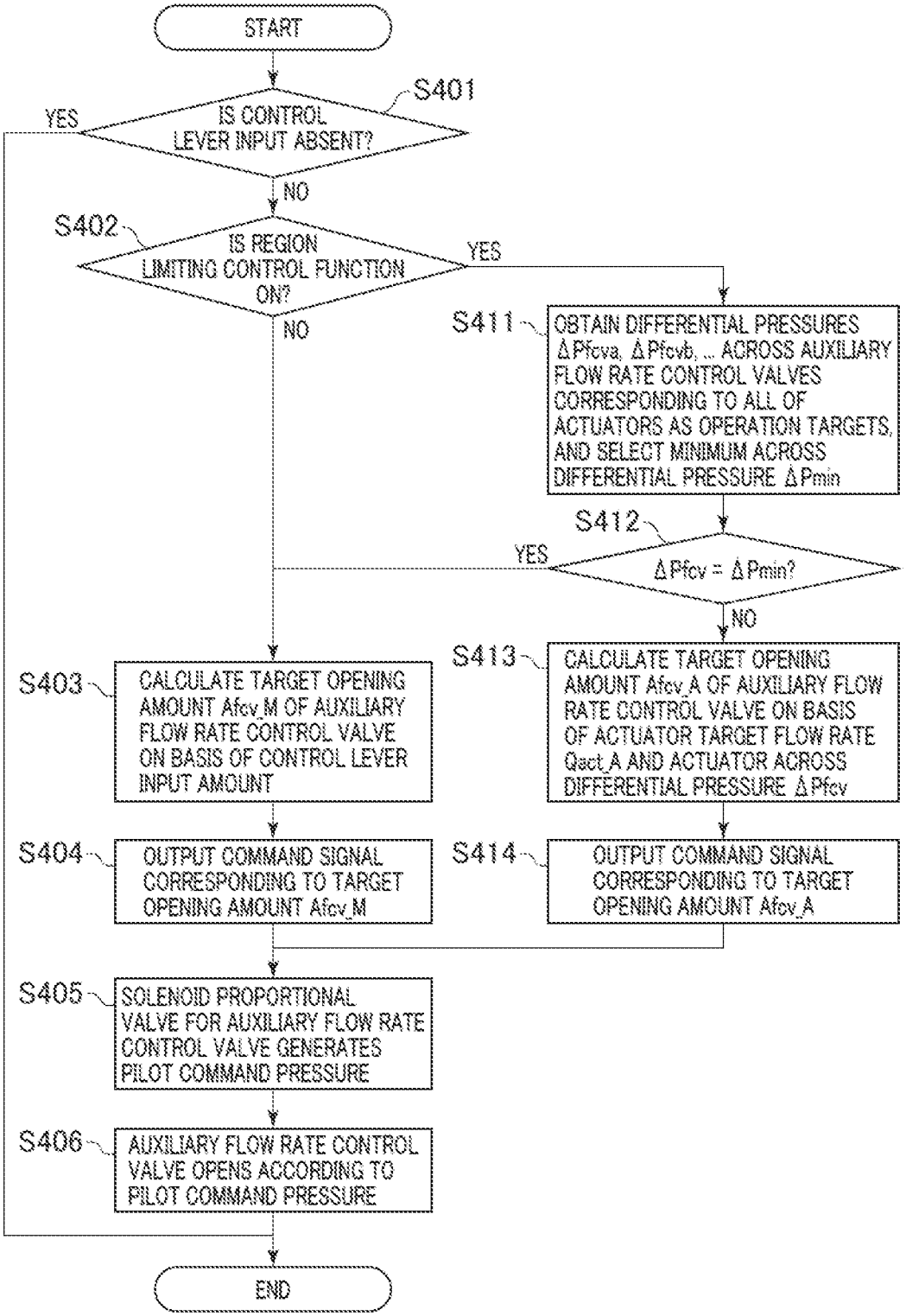
FIG. 9 is a flowchart indicating processing related to control on auxiliary flow rate control valves by the controller depicted in FIG. 2B.

FIG. 9 is a flowchart indicating processing related to control on the auxiliary flow rate control valves 21 to 29 by the controller 94. In the following, description will be made of only the processing related to the control on the auxiliary flow rate control valve 24 corresponding to the second boom directional control valve 10. The processing related to the control on the other auxiliary flow rate control valves is similar to this, and therefore, description thereof will be omitted.

The controller 94 first determines whether or not input of the boom control lever 95*a* is absent (step S401). When the controller 94 determines in step S401 that input of the boom control lever 95*a* is absent (YES), the controller 94 ends the flow.

When the controller 94 determines in step S401 that there is input of the boom control lever 95*a* (NO), the controller 94 determines whether or not the region limiting control function is enabled (step S402).

When the controller 94 determines in step S402 that the region limiting control function is disabled (NO), the target flow rate control valve opening computing section 94*j* of the controller 94 calculates a target opening amount Afcv_M of the auxiliary flow rate control valve 24 (main valve 31) which corresponds to an input amount of the boom control lever 95*a* (step S403), outputs a command signal corresponding to the target opening amount Afcv_M to the solenoid proportional valve 93*i* for the auxiliary flow rate control valve 24 (S404), makes the solenoid proportional valve 93*i* generate a pilot command pressure of the pilot variable restrictor 32 (S405), makes the auxiliary flow rate control valve 24 (main valve 31) open according to the pilot command pressure (S406), and then ends the flow.

When the controller 94 determines in step S402 that the region limiting control function is enabled (YES), the pressure state determining section 94*i* of the controller 94 obtains differential pressures ΔPfcva, ΔPfcvb, . . . , across the auxiliary flow rate control valves (main valves) corresponding to all of the actuators as operation targets, and selects a minimum value of these differential pressures (minimum across differential pressure ΔPmin) (step S411).

Following step S411, the controller 94 determines whether or not the differential pressure ΔPfcv across the auxiliary flow rate control valve 24 (main valve 31) is equal to the minimum across differential pressure ΔPmin (step S412).

When the controller 94 determines in step S412 that the differential pressure ΔPfcv across the auxiliary flow rate control valve 24 (main valve 31) is equal to the minimum across differential pressure ΔPmin (YES), the controller 94 performs the processing from step S403 on down. Consequently, the auxiliary flow rate control valve 24 (main valve 31) opens according to the input amount of the boom control lever 95*a*, and the limitation of the passing flow rate for the directional control valve 10 is canceled.

When the controller 94 determines in step S412 that the differential pressure ΔPfcv across the main valve 31 is not equal to the minimum across differential pressure ΔPmin (NO), the target flow rate control valve opening computing section 94*j* of the controller 94 calculates a target opening amount Afcv_A of the main valve 31 on the basis of the target flow rate Qact_A of the actuator 204*a* and the differential pressure ΔPfcv across the main valve 31 (step S413), outputs a command signal corresponding to the target opening amount Afcv_A to the solenoid proportional valve 93*i* (S414), performs the processing of steps S405 and S405, and thereafter ends the flow. Consequently, the auxiliary flow rate control valve 24 (main valve 31) opens according to the target flow rate of the actuator 204*a*, and the passing flow rate of the directional control valve 10 is limited.

It is to be noted that, while, in the above-described configuration, the region limiting control function that prevents the machine body 202 and the work device 203 from entering a preset region has been cited as an example of the automatic control function of the controller 94, the automatic control function according to the present invention is not limited to the region limiting control function described in the above description, but, for example, includes automatic control in which the controller 94 outputs a command such that a distal end of the bucket 206 is along a preset target trajectory, and the like.

(2) Operation

Operation of the hydraulic drive system 400 will be described by citing a part related to the second hydraulic pump 2. Operation of parts related to the other hydraulic pumps is similar to this, and therefore, description thereof will be omitted.

(2-1) Case of "Manual Operation by Operator" and "No Flow Division"

Description will be made of an operation of each apparatus when only the arm control lever 95*b* is operated in a state in which the region limiting control function is disabled (that is, when flow division from the second hydraulic pump 2 to a plurality of actuators does not occur in a manual operation by an operator).

Bleed-Off Valve

The controller 94 calculates the target opening amount Abo_M of the bleed-off valve 36 which corresponds to an input amount of the arm control lever 95*b*, and outputs a command signal corresponding to the target opening amount Abo_M to the solenoid proportional valve 93*g*. The solenoid proportional valve 93*g* generates a pilot command pressure according to the command signal, and thereby controls the opening amount of the bleed-off valve 36.

Hydraulic Pump

The controller 94 calculates the target flow rate Qpmp_M of the second hydraulic pump which corresponds to the input amount of the arm control lever 95*b*, and outputs a command signal corresponding to the target flow rate Qpmp_M to the solenoid proportional valve 93*a*. The solenoid proportional valve 93*a* generates a pilot command pressure PiP2 according to the command signal, and thereby controls the flow rate of the second hydraulic pump 2.

Directional Control Valve

The controller 94 calculates the target opening amount Ams of the first arm directional control valve 11 which corresponds to the input amount of the arm control lever 95*b*, and outputs command signals corresponding to the target opening amount Ams to the solenoid proportional valves 93*d* and 93*e*. The solenoid proportional valves 93*d* and 93*e* generate pilot command pressures PiAm1U and PiAm1D according to the command signals, and thereby control the opening amount of the first arm directional control valve 11.

Auxiliary Flow Rate Control Valve

The controller 94 calculates the target opening amount Afcv_M of the auxiliary flow rate control valve 25 (main valve 33) which corresponds to the input amount of the arm control lever 95*b*, and outputs a command signal corresponding to the target opening amount Afcv_M to the solenoid proportional valve 93*j*. The solenoid proportional valve 93*j* generates a pilot command pressure according to the command signal, and thereby controls the opening amount of the main valve 33. In the present operation example, control is performed such that the opening amount of the auxiliary flow rate control valve 25 (main valve 33) is at a maximum (the auxiliary flow rate control valve 25 (main valve 33) is fully opened).

The above operation can drive the actuator 205*a* according to a lever operation of the operator. At this time, a bleed-off function can smooth the operation by reducing vibration and shock at a time of a start of operation of the actuator 205*a*, so that excellent operability is ensured.

(2-2) Case of "Manual Operation by Operator" and "Presence of Flow Division"

Description will be made of an operation of each apparatus when the boom control lever 95*a* and the arm control lever 95*b* are operated in a state in which the region limiting control function is disabled (that is, when flow division from the second hydraulic pump 2 to the two actuators 204*a* and 205*a* occurs in a manual operation by the operator).

Bleed-Off Valve

The controller 94 calculates the target opening amount Abo_M of the bleed-off valve 36 which corresponds to an input amount of the boom control lever 95*a* or the arm control lever 95*b*, and outputs a command signal corresponding to the target opening amount Abo_M to the solenoid proportional valve 93*g*. The solenoid proportional valve 93*g* generates a pilot command pressure according to the command signal, and thereby controls the opening amount of the bleed-off valve 36.

Hydraulic Pump

The controller 94 calculates the target pump flow rate Qpmp_M of the second hydraulic pump which corresponds to the input amounts of the boom control lever 95*a* and the arm control lever 95*b*, and outputs a command signal corresponding to the target flow rate Qpmp_M to the solenoid proportional valve 93*a*. The solenoid proportional valve 93*a* generates a pilot command pressure PiP2 according to the command signal, and thereby controls the flow rate of the second hydraulic pump 2. In the present operation example, control is performed such that the flow rate of the second hydraulic pump 2 is at least larger than a flow rate necessary for the movement of the arm 205 according to the input amount of the arm control lever 95*b*.

Directional Control Valve

The controller 94 calculates the target opening amount Ams of the first arm directional control valve 11 which corresponds to the input amount of the arm control lever 95*b*, and outputs command signals corresponding to the target opening amount Ams to the solenoid proportional valves 93*d* and 93*e*. The solenoid proportional valves 93*d* and 93*e* generate pilot command pressures PiAm1U and PiAm1D according to the command signals, and thereby control the opening amount of the first arm directional control valve 11. At the same time, the controller 94 calculates the target opening amount Ams of the second boom directional control valve 10 which corresponds to the input amount of the boom control lever 95*a*, and outputs command signals corresponding to the target opening amount Ams to the solenoid proportional valves 93*b* and 93*c*. The solenoid proportional valves 93*b* and 93*c* generate pilot command pressures PiBm2U and PiBm2D according to the command signals, and thereby control the opening amount of the second boom directional control valve 10.

Auxiliary Flow Rate Control Valve

The controller 94 calculates the target opening amount Afcv_M of the auxiliary flow rate control valve 25 (main valve 33) which corresponds to the input amounts of the boom control lever 95*a* and the arm control lever 95*b*, and outputs a command signal corresponding to the target opening amount Afcv_M to the solenoid proportional valve 93*j*. The solenoid proportional valve 93*j* generates a pilot command pressure according to the command signal, and thereby controls the opening amount of the auxiliary flow rate control valve 25 (main valve 33). At the same time, the controller 94 calculates the target opening amount Afcv_M of the auxiliary flow rate control valve 24 (main valve 31) which corresponds to the input amounts of the boom control lever 95*a* and the arm control lever 95*b*, and outputs a command signal corresponding to the target opening amount Afcv_M to the solenoid proportional valve 93*i*. The solenoid proportional valve 93*i* generates a pilot command pressure according to the command signal, and thereby controls the opening amount of the main valve 31 of the auxiliary flow rate control valve 24. In the present operation example, control is performed so as to fully open the auxiliary flow rate control valve 24 (main valve 31) corresponding to the second boom directional control valve 10 and narrow the opening of the auxiliary flow rate control valve 25 (main valve 33) corresponding to the first arm directional control valve 11.

The above operation can drive the actuators 204*a* and 205*a* according to lever operations of the operator. At this time, the bleed-off function smooths the operation by reducing vibration and shock at a time of a start of operation of the actuators 204*a* and 205*a*, so that excellent operability is ensured.

(2-3) Case of "Automatic Operation Under Region Limiting Control" and "No Flow Division"

Description will be made of an operation of each apparatus when only the arm control lever 95*b* is operated in a state in which the region limiting control function is enabled (that is, when flow division from the second hydraulic pump 2 to a plurality of actuators does not occur in an automatic operation under region limiting control.

Bleed-Off Valve

The controller 94 calculates the target opening amount Abo_A of the bleed-off valve 36 which corresponds to an input amount of the arm control lever 95*b*, and outputs a command signal corresponding to the target opening amount Abo_A to the solenoid proportional valve 93*g*. The solenoid proportional valve 93*g* generates a pilot command pressure according to the command signal, and thereby controls the opening amount of the bleed-off valve 36. In the present operation example, control is performed such that the target opening amount Abo_A of the bleed-off valve 36 is zero (that is, the bleed-off valve 36 is fully closed).

Hydraulic Pump

The controller 94 calculates the target pump flow rate Qpmp_A of the second hydraulic pump, and outputs a command signal corresponding to the target pump flow rate Qpmp_A to the solenoid proportional valve 93*a*. The solenoid proportional valve 93*a* generates a pilot command pressure PiP2 according to the command signal, and thereby controls the flow rate of the second hydraulic pump 2. In the present operation example, the bleed-off valve 36 is fully closed (that is, the estimated bleed-off flow rate is zero). Thus, the target pump flow rate Qpmp_A is controlled according to the input amount of the arm control lever 95*b* or so as to be equal to the target flow rate Qact_A of the actuator which is calculated by the region limiting control function.

Directional Control Valve

The controller 94 calculates the target opening amount Ams of the first arm directional control valve 11 which corresponds to the input amount of the arm control lever 95*b*, and outputs command signals corresponding to the target opening amount Ams to the solenoid proportional valves 93*d* and 93*e*. The solenoid proportional valves 93*d* and 93*e* generate pilot command pressures PiAm1U and PiAm1D according to the command signals, and thereby control the opening amount of the first arm directional control valve 11.

Auxiliary Flow Rate Control Valve

The controller 94 selects the differential pressure ΔPfcv across the auxiliary flow rate control valve 25 (main valve 33) corresponding to the arm cylinder 205*a* as the minimum across differential pressure ΔPmin. Because the differential pressure ΔPfcv across the auxiliary flow rate control valve 25 (main valve 33) and the minimum across differential pressure ΔPmin coincide with each other, the controller 94 calculates the target opening amount Afcv_M of the auxiliary flow rate control valve 25 (main valve 33) which corresponds to the input amount of the arm control lever 95*b*, and outputs a command signal corresponding to the target opening amount Afcv_M to the solenoid proportional valve 93*j*. The solenoid proportional valve 93*j* generates a pilot command pressure according to the command signal, and thereby controls the opening amount of the auxiliary flow rate control valve 25 (main valve 33). In the present operation example, control is performed such that the opening amount of the auxiliary flow rate control valve 25 is a maximum opening amount.

Consequently, the actuator can be driven by control of the controller 94, and the region limiting control on the hydraulic excavator 300 can be performed. At this time, the bleed-off valve 36 is fully closed, so that a bleed-off flow rate discharged from the bleed-off valve 36 to the hydraulic fluid tank 5 is eliminated. Therefore, the hydraulic fluid delivered from the second hydraulic pump 2 is supplied to the actuator without being affected by the bleed-off flow rate. It is thus possible to eliminate a shortage of the flow rate supplied for the target flow rate of the actuator and an increase in a delay time until the target flow rate is reached, and drive the actuator without incurring a decrease in accuracy of control of the position and speed of the actuator.

It is to be noted that, while operation when the bleed-off valve 36 is fully closed has been described in the above description, the bleed-off valve 36 does not necessarily need to be fully closed. When the opening amount of the bleed-off valve 36 is adjusted, in at least part of an operation region, so as to be smaller than the opening amount of the bleed-off valve 36 for the control lever input amount when the region limiting control function is disabled (when the operator performs manual operation), an effect of the bleed-off flow rate when the region limiting control function is enabled on the actuator control can be reduced, and thus, the effect of improving the accuracy of the actuator control can be obtained.

(2-4) Case of "Automatic Operation Under Region Limiting Control" and "Presence of Flow Division"

Description will be made of an operation of each apparatus when the boom control lever 95*a* and the arm control lever 95*b* are operated in a state in which the region limiting control function is enabled (that is, when flow division from the second hydraulic pump 2 to a plurality of actuators occurs in an automatic operation under the region limiting control).

Bleed-Off Valve

The controller 94 calculates the target opening amount Abo_A of the bleed-off valve 36 which corresponds to an input amount of the boom control lever 95*a* or the arm control lever 95*b*, and outputs a command signal corresponding to the target opening amount Abo_A to the solenoid proportional valve 93*g*. The solenoid proportional valve 93*g* generates a pilot command pressure according to the command signal, and thereby controls the opening amount of the bleed-off valve 36. In the present operation example, control is performed such that the target opening amount Abo_A of the bleed-off valve 36 is zero (that is, the bleed-off valve 36 is fully closed).

Hydraulic Pump

The controller 94 calculates the target pump flow rate Qpmp_A of the second hydraulic pump 2, and outputs a command signal corresponding to the target pump flow rate Qpmp_A to the solenoid proportional valve 93*a*. The solenoid proportional valve 93*a* generates a pilot command pressure PiP2 according to the command signal, and thereby controls the flow rate of the second hydraulic pump 2. In the present operation example, the bleed-off valve 36 is fully closed (that is, the estimated bleed-off flow rate is zero). Thus, the target pump flow rate Qpmp_A is controlled according to input amounts of the boom control lever 95*a* and the arm control lever 95*b* or so as to be equal to a sum of the target actuator flow rates Qact_Aa and Qact_Ab calculated by the region limiting control function.

Directional Control Valve

The controller 94 calculates the target opening amount Ams of the first arm directional control valve 11 which corresponds to the input amount of the arm control lever 95*b*, and outputs command signals corresponding to the target opening amount Ams to the solenoid proportional valves 93*d* and 93*e*. The solenoid proportional valves 93*d* and 93*e* generate pilot command pressures PiAm1U and PiAm1D according to the command signals, and thereby control the opening amount of the first arm directional control valve 11. At the same time, the controller 94 calculates the target opening amount Ams of the second boom directional control valve 10 which corresponds to the input amount of the boom control lever 95*a*, and outputs command signals corresponding to the target opening amount Ams to the solenoid proportional valves 93*b* and 93*c*. The solenoid proportional valves 93*b* and 93*c* generate pilot command pressures PiBm2U and PiBm2D according to the command signals, and thereby control the opening amount of the second boom directional control valve 10.

Auxiliary Flow Rate Control Valve

The controller 94 selects, as the minimum across differential pressure ΔPmin, a minimum value of a differential pressure ΔPfcva across the auxiliary flow rate control valve (main valve 31) corresponding to the boom cylinder 204*a* and a differential pressure ΔPfcvb across the auxiliary flow rate control valve 25 (main valve 33) corresponding to the arm cylinder 205*a*. In the present operation example, the differential pressure ΔPfcva across the auxiliary flow rate control valve 24 (main valve 31) is set as the minimum across differential pressure ΔPmin.

Because the differential pressure ΔPfcva across the auxiliary flow rate control valve 24 (main valve 31) and the minimum across differential pressure ΔPmin coincide with each other, the controller 94 calculates the target opening amount Afcv_M of the auxiliary flow rate control valve 24 (main valve 31) which corresponds to the input amount of the boom control lever 95*a*, and outputs a command signal corresponding to the target opening amount Afcv_M to the solenoid proportional valve 93*i*. The solenoid proportional valve 93*i* generates a pilot command pressure according to the command signal, and thereby controls the opening amount of the auxiliary flow rate control valve 24 (main valve 31). In the present operation example, control is performed such that the opening amount of the auxiliary flow rate control valve 24 (main valve 31) is a maximum opening amount.

At the same time, because the differential pressure ΔPfcva across the auxiliary flow rate control valve 25 (main valve 33) and the minimum across differential pressure ΔPmin do not coincide with each other, the controller 94 calculates the target opening amount Afcv_M of the auxiliary flow rate control valve 25 (main valve 33) according to the input amount of the arm control lever 95*b* or on the basis of the target flow rate Qact_A of the actuator which is calculated by the region limiting control function and the differential pressure ΔPfcv across the auxiliary flow rate control valve 25 (main valve 33) which is obtained from the signals of the pressure sensors 81 and 83. The controller 94 outputs a command signal corresponding to the target opening amount Afcv_M to the solenoid proportional valve 93*j*. The solenoid proportional valve 93*j* generates a pilot command pressure according to the command signal, and thereby controls the opening amount of the auxiliary flow rate control valve 25 (main valve 33).

Consequently, the flow rate control function of the auxiliary flow rate control valve 25 is enabled, and the opening amount of the auxiliary flow rate control valve 25 (main valve 33) is adjusted according to the differential pressure across the auxiliary flow rate control valve 25 (main valve 33). It is therefore possible to prevent destabilization of the flow rate supplied to the arm cylinder 205*a* due to load variation of the arm cylinder 205*a*.

(3) Effects

In the present embodiment, the work machine 300 includes the machine body 202, the work device 203 attached to the machine body 202, the plurality of actuators 204*a*, 205*a*, 206*a*, and 211 that drive the machine body 202 or the work device 203, the hydraulic fluid tank 5, the hydraulic pumps 1 to 3 that suck the hydraulic fluid from the hydraulic fluid tank 5 and that supply the hydraulic fluid to the plurality of actuators 204*a*, 205*a*, 206*a*, and 211, the plurality of flow rate controllers 6 to 16 and 21 to 29 that are connected in parallel to the delivery lines 40, 50, and 60 of the hydraulic pumps 1 to and that control flow rates of the hydraulic fluid supplied from the hydraulic pumps 1 to 3 to the plurality of actuators 204*a*, 205*a*, 206*a*, and 211, the control levers 95*a* and 95*b* for giving instructions for operation of the plurality of actuators 204*a*, 205*a*, 206*a*, and 211, the pilot pump 91, the plurality of solenoid proportional valves 93*a* to 93*j* that reduce the pressure of hydraulic fluid supplied from the pilot pump 91 and that generate operation pressures of the plurality of flow rate controllers 6 to 16 and 21 to 29, the controller 94 that outputs command signals to the plurality of solenoid proportional valves 93*a* to 93*j* according to operation amounts of the control levers 95*a* and 95*b*, the automatic control function selector switch 96 for giving an instruction to enable or disable the automatic control function for the machine body 202 or the work device 203, the controller 94 being configured to, in a case where the automatic control function selector switch 96 gives an instruction to enable the automatic control function, perform the automatic control function by correcting the command signals to the plurality of solenoid proportional valves 93*a* to 93*j*, and the bleed-off valves 35 to 37 that are arranged on the hydraulic fluid lines 41, 51, and 61 connecting the delivery lines 40, 50, and 60 to the hydraulic fluid tank 5 and that adjust flow rates of the hydraulic fluid returned from the delivery lines 40, 50, and 60 to the hydraulic fluid tank 5, the controller 94 being configured to, in a case where the automatic control function selector switch 96 gives an instruction to disable the automatic control function, adjust the opening amounts of the bleed-off valves 35 to 37 to a maximum opening amount or an opening amount Abo_M corresponding to input amounts of the control levers 95*a* and 95*b*, and in a case where the automatic control function selector switch 96 gives the instruction to enable the automatic control function, adjust the opening amounts Abo_A of the bleed-off valves 35 to 37, in at least a part of an operation region of the control levers 95*a* and 95*b*, so as to be smaller than the opening amount Abo_M with the instruction to disable the automatic control function being given.

According to the present embodiment configured as described above, when the region limiting control function is disabled (when the operator manually operates the machine body 202 or the work device 203), the bleed-off function smooths operation by reducing vibration and shock at a time of a start of operation of an actuator, and thereby excellent operability can be ensured. On the other hand, when the region limiting control function is enabled (when the controller 94 performs automatic control), a shortage of the flow rate supplied from the hydraulic pump 1 to 3 for the target flow rate of the actuator and a delay until the target flow rate is reached are eliminated by suppressing the bleed-off function, and thus, an accuracy of control of the actuator can be ensured. It is thereby possible to achieve both of excellent operability when the operator manually operates the machine body 202 or the work device 203 and an accuracy of control of the machine body 202 or the work device 203 when the controller 94 performs automatic control.

In addition, the work machine 300 according to the present embodiment includes the first pressure sensors 87 to 89 that detect the differential pressures across the bleed-off valves 35 to 37, and the controller 94 is configured to, in a case where the region limiting control function selector switch (automatic control function selector switch) 96 gives an instruction to enable the region limiting control function (automatic control function), calculate the respective target flow rates of the plurality of actuators 204*a*, 205*a*, 206*a*, and 211, the target flow rates corresponding to the input amounts of the control levers 95*a* and 95*b*, calculate the passing flow rates (estimated bleed-off flow rate Qbo_A) of the bleed-off valves 35 to 37 on the basis of the opening amounts Abo_A of the bleed-off valves 35 to 37 and the differential pressures across the bleed-off valves 35 to 37, the differential pressures being detected by the first pressure sensors 87 to 89, and adjust delivery flow rates of the hydraulic pumps 1 to 3 so as to be equal to sums of the respective target flow rates of the plurality of actuators 204*a*, 205*a*, 206*a*, and 211 and the passing flow rates (estimated bleed-off flow rate Qbo_A) of the bleed-off valves 35 to 37. Consequently, the target flow rates can be supplied to the respective actuators without being affected by bleed-off flow rates while the delivery flow rates of the hydraulic pumps 1 to 3 are minimized.

In addition, in the present embodiment, the plurality of flow rate controllers 6 to 16 and 21 to 29 include the plurality of directional control valves 6 to 16 that control directions of the hydraulic fluid supplied to the plurality of actuators 204*a*, 205*a*, 206*a*, and 211 and the plurality of auxiliary flow rate control valves 21 to 29 that control flow rates of the hydraulic fluid supplied to the plurality of directional control valves 6 to 16, the work machine 300 includes the second pressure sensors 81 to 83 that detect respective differential pressures across the plurality of auxiliary flow rate control valves 21 to 29 (main valves 31 and 33), the controller 94 has a flow rate limiting function of limiting respective passing flow rates of the plurality of directional control valves 6 to 16 by adjusting respective opening amounts of the plurality of auxiliary flow rate control valves 21 to 29 (main valves 31 and 33) according to the respective differential pressures across the plurality of auxiliary flow rate control valves 21 to 29, the differential pressures being detected by the second pressure sensors 81 to 83, and the controller 94 is configured to, in a case where the region limiting control function selector switch (automatic control function selector switch) 96 gives the instruction to disable the region limiting control function (automatic control function), disable the flow rate limiting function, and in a case where the automatic control function selector switch 96 gives the instruction to enable the automatic control function, enable the flow rate limiting function. Consequently, in the hydraulic drive system 400 in which the flow rate controllers 6 to 16 and 21 to 29 are constituted by the directional control valves 6 to 16 and the auxiliary flow rate control valves 21 to 29, it is possible to achieve both of excellent operability when the operator manually operates the machine body 202 or the work device 203 and an accuracy of control of the machine body 202 or the work device 203 when the controller 94 performs automatic control.

In addition, the controller 94 is configured to, in a case where the region limiting control function selector switch (automatic control function selector switch) 96 gives the instruction to enable the region limiting control function (automatic control function) and instructions for operation of the two or more actuators are simultaneously given via the control levers 95*a* and 95*b*, cancel limitation of a passing flow rate, the limitation being performed by an auxiliary flow rate control valve having a smallest across differential pressure among two or more auxiliary flow rate control valves corresponding to two or more actuators among the plurality of actuators 204*a*, 205*a*, 206*a*, and 211, the two or more auxiliary flow rate control valves being included in the plurality of auxiliary flow rate control valves 21 to 29. Accordingly, when errors occur between the delivery flow rates of the hydraulic pumps 1 to 3 and the target pump flow rates Qpmp_A, it is possible to prevent destabilization of the hydraulic system (for example, the delivery flow rates of the hydraulic pumps 1 to 3 are too large, and the pressures of the delivery lines 40, 50, and 60 rise to a main relief pressure) due to the errors in the delivery flow rates of the hydraulic pumps 1 to 3 by canceling flow rate limitation on the auxiliary flow rate control valve having the smallest across differential pressure and including the errors in the delivery flow rates of the hydraulic pumps 1 to 3 in the flow rates supplied to actuators on which a maximum load acts.

Embodiments of the present invention have been described above in detail. However, the present invention is not limited to the foregoing embodiments and includes various modifications. For example, the foregoing embodiments have been described in detail in order to describe the present invention in an easily understandable manner and are not necessarily limited to the embodiments including all of the described configurations.

DESCRIPTION OF REFERENCE CHARACTERS

1: First hydraulic pump
1*a*: Flow rate control command pressure port (regulator)
1*b*: First hydraulic pump self-pressure port (regulator)
1*c*: Second hydraulic pump self-pressure port (regulator)
2: Second hydraulic pump
2*a*: Flow rate control command pressure port (regulator)
2*b*: Second hydraulic pump self-pressure port (regulator)
2*c*: First hydraulic pump self-pressure port (regulator)
3: Third hydraulic pump
3*a*: Flow rate control command pressure port (regulator)
3*b*: Third hydraulic pump self-pressure port (regulator)
5: Hydraulic fluid tank
6: Right travelling directional control valve (flow rate controller)
7: Bucket directional control valve (flow rate controller)
8: Second arm directional control valve (flow rate controller)
9: First boom directional control valve (flow rate controller)
10: Second boom directional control valve (flow rate controller)
11: First arm directional control valve (flow rate controller)
12: First attachment directional control valve (flow rate controller)
13: Left travelling directional control valve (flow rate controller)
14: Swing directional control valve (flow rate controller)
15: Third boom directional control valve (flow rate controller)
16: Second attachment directional control valve (flow rate controller)
17: Confluence valve
18 to 20: Main relief valve
21 to 29: Auxiliary flow rate control valve (flow rate controller)
31: Main valve
31*a*: Valve body
31*b*: Control variable restrictor
31*c*: First pressure chamber
31*d*: Second pressure chamber
31*e*: Third pressure chamber
32: Pilot variable restrictor
32*a*: Pilot port
33: Main valve
33*a*: Valve body
33*b*: Control variable restrictor
33*c*: First pressure chamber
33*d*: Second pressure chamber
33*e*: Third pressure chamber
34: Pilot variable restrictor
34*a*: Pilot port
35 to 37: Bleed-off valve
41: Center bypass hydraulic fluid line
42 to 47: Hydraulic fluid line
51: Center bypass hydraulic fluid line
52 to 58: Hydraulic fluid line
61: Center bypass hydraulic fluid line
62 to 67, 68*a*, 68*b*, 69*a*, 69*b*, 71 to 75: Hydraulic fluid line
81 to 83: Pressure sensor (second pressure sensor)
84 to 86: Stroke sensor
87 to 89: Pressure sensor (first pressure sensor)
91: Pilot pump
92: Pilot relief valve
93: Solenoid valve unit
93*a* to 93*j*: Solenoid proportional valve
94: Controller
94*a*: Control enablement determining section
94*b*: Target bleed-off valve opening computing section
94*c*: Demanded actuator flow rate computing section
94*d*: Limited actuator flow rate computing section
94*e*: Target actuator flow rate computing section
94*f*: Estimated bleed-off flow rate computing section
94*g*: Target pump flow rate computing section

94*h*: Target directional control valve opening computing section
94*i*: Pressure state determining section
94*j*: Target flow rate control valve opening computing section
95*a*: Boom control lever
95*b*: Arm control lever
96: Region limiting control function selector switch (automatic control function selector switch)
97: Hydraulic fluid line
201: Track structure
202: Swing structure (machine body)
203: Work device
204: Boom
204*a*: Boom cylinder (actuator)
205: Arm
205*a*: Arm cylinder (actuator)
206: Bucket
206*a*: Bucket cylinder (actuator)
207: Cab
208: Machine room
209: Counterweight
210: Control valve
211: Swing motor (actuator)
300: Hydraulic excavator (work machine)
400: Hydraulic drive system

The invention claimed is:

1. A work machine comprising:

a machine body;

a work device attached to the machine body;

a plurality of actuators that drive the machine body or the work device;

a hydraulic fluid tank;

a hydraulic pump that sucks hydraulic fluid from the hydraulic fluid tank and that supplies the hydraulic fluid to the plurality of actuators;

a plurality of flow rate controllers that are connected in parallel to a delivery line of the hydraulic pump and that control flow rates of the hydraulic fluid supplied from the hydraulic pump to the plurality of actuators;

control levers for giving instructions for operation of the plurality of actuators;

a pilot pump;

a plurality of solenoid proportional valves that reduce pressure of hydraulic fluid supplied from the pilot pump and that generate operation pressures of the plurality of flow rate controllers;

a controller that outputs command signals to the plurality of solenoid proportional valves according to operation amounts of the control levers; and an automatic control function selector switch for giving an instruction to enable or disable an automatic control function for the machine body or the work device, the controller being configured to, in a case where the automatic control function selector switch gives an instruction to enable the automatic control function, perform the automatic control function by correcting the command signals to the plurality of solenoid proportional valves, wherein the work machine includes a bleed-off valve that is disposed on a hydraulic fluid line connecting the delivery line to the hydraulic fluid tank and adjusts a flow rate of the hydraulic fluid returned from the delivery line to the hydraulic fluid tank, and the controller is configured to, in a case where the automatic control function selector switch gives an instruction to disable the automatic control function, adjust an opening amount of the bleed-off valve to a maximum opening amount or an opening amount corresponding to input amounts of the control levers, and in a case where the automatic control function selector switch gives the instruction to enable the automatic control function, adjust the opening amount of the bleed-off valve, in at least part of an operation region of the control levers, so as to be smaller than the opening amount with the instruction to disable the automatic control function being given.

2. The work machine according to claim 1, wherein the work machine includes a first pressure sensor that detects a differential pressure across the bleed-off valve, and the controller is configured to, in a case where the automatic control function selector switch gives the instruction to enable the automatic control function, calculate respective target flow rates of the plurality of actuators, the target flow rates corresponding to the input amounts of the control levers, calculate a passing flow rate of the bleed-off valve on a basis of the opening amount of the bleed-off valve and the differential pressure across the bleed-off valve, the differential pressure being detected by the first pressure sensor, and adjust a delivery flow rate of the hydraulic pump so as to be equal to a sum of the respective target flow rates of the plurality of actuators and the passing flow rate of the bleed-off valve.

3. The work machine according to claim 2, wherein the plurality of flow rate controllers include a plurality of directional control valves that control directions of the hydraulic fluid supplied to the plurality of actuators and a plurality of auxiliary flow rate control valves that control flow rates of the hydraulic fluid supplied to the plurality of directional control valves, the work machine includes second pressure sensors that detect respective differential pressures across the plurality of auxiliary flow rate control valves, the controller has a flow rate limiting function of limiting respective passing flow rates of the plurality of directional control valves by adjusting respective opening amounts of the plurality of auxiliary flow rate control valves according to the respective differential pressures across the plurality of auxiliary flow rate control valves, the differential pressures being detected by the second pressure sensors, and the controller is configured to, in a case where the automatic control function selector switch gives the instruction to disable the automatic control function, disable the flow rate limiting function, and in a case where the automatic control function selector switch gives the instruction to enable the automatic control function, enable the flow rate limiting function.

4. The work machine according to claim 3, wherein the controller is configured to, in a case where the automatic control function selector switch gives the instruction to enable the automatic control function and instructions for operation of the two or more actuators are simultaneously given via the control levers, cancel limitation of a passing flow rate, the limitation being performed by an auxiliary flow rate control valve having a smallest across differential pressure among two or more auxiliary flow rate control valves corresponding to two or more actuators among the plurality of actuators, the two or more auxiliary flow rate control valves being included in the plurality of auxiliary flow rate control valves.

* * * * *